United States Patent [19]

Van Auken et al.

[11] Patent Number: 4,859,986

[45] Date of Patent: Aug. 22, 1989

[54] OBJECT TOUCHDOWN AND NET CONTACT DETECTION SYSTEMS AND GAME APPARATUS EMPLOYING SAME

[76] Inventors: John A. Van Auken, 16 LaGorce Cir., Miami Beach, Fla. 33141; M. Gene Kaufman, 6771 Southwest 76th Ter., South Miami, Fla. 33143

[21] Appl. No.: 100,712

[22] Filed: Sep. 24, 1987

[51] Int. Cl.[4] ..... G08B 23/00; A63B 61/00

[52] U.S. Cl. ..... 340/323 R; 340/665; 200/61.1; 73/862.38; 273/29 B; 273/31; 273/61 B; 273/181 E

[58] Field of Search ..... 340/323 R, 665; 273/29 B, 31, 61 R, 61 B, 29 R, 181 E, 73 F, 73 R; 73/862.43, 862.38, 862.48, 862.45; 200/61.1, 61.13

[56] References Cited

U.S. PATENT DOCUMENTS 3,854,719 12/1974 Supran ..... 273/61 R
3,883,860 5/1975 Von Kohorn ..... 273/31
4,109,911 8/1978 Van Auken ..... 273/61 R
4,432,058 2/1984 Supran ..... 340/323 R
4,664,378 5/1987 Van Auken ..... 273/61 R

*Primary Examiner*—Donnie L. Crosland
*Attorney, Agent, or Firm*—Hughes & Multer

[57] ABSTRACT

Systems for automatically determining whether a conductive, volant game device touches down in bounds or out of bounds on a playing surface. The system includes boundary line and out of bounds circuits which can be completed by the touchdown of the game device thereupon. A control unit processes the signal generated by each completed circuit and turns on a signal which is coded to indicate whether the device touched down in bounds or out of bounds. Associated circuits and control capabilities provide a signal when the game device touches the top of a net or other barrier in games in which that type of contact is significant.

20 Claims, 13 Drawing Sheets

54
RAM MEMORY
56
E PROM PROGRAM MEMORY
48
96
50
SYSTEM BUS
86
90
88
84
82
58
I/O
SENSE
SCAN
KEYBOARD
CPU AND SATELLITE CHIPS
52
46
42
40
ANALOG LEVEL SENSE CIRCUITS
8
8
8
FROM TENNIS COURT 20
80
60
76
78
IN
IN
FAULT
OUT
CONTROL BOX
566
568
SERVICE COURT SELECT SWITCHES
74
562
564

OBJECT TOUCHDOWN AND NET CONTACT DETECTION SYSTEMS AND GAME APPARATUS EMPLOYING SAME

TECHNICAL FIELD OF THE INVENTION

In one aspect, the present invention relates to novel, improved systems for detecting the touchdown of a missile-type device such as a ball on a playing surface and, more particularly, to such systems which are furthermore capable of identifying the specific location on the playing surface where the device touched down.

In a second aspect, the present invention relates to a system for automatically ascertaining whether a missile-type game device such as a ball touched down in bounds or out of bounds on a playing surface such as a tennis court.

In yet another aspect the present invention relates to systems as characterized in the preceding paragraphs which are particularly designed for games such as tennis in which the game device crosses a net or other barrier in flight and which are capable of providing a signal if the device clears but touches the net in situations in which ball-with-net contact effects the next step to be taken in the game.

In still another aspect, the present invention relates to novel, improved playing surface components providing exposed electrical circuits which are completed when bridged by a missile-type device.

As suggested in the preceding paragraphs, one important, current application of the present invention is systems for automatically and accurately determining whether a ball lands in or out of bounds on a tennis court in those cases where the ball touches down close to a boundary line and, further, such systems which are capable of detecting lets.

For the sake of convenience, the principles of the present invention will be developed by relating them to a system of the type described in the preceding paragraph. It is, however, to be understood by the reader that this is being done for the sake of clarity and for convenience and that this approach is not intended to limit the scope of the invention as defined in the appended claims.

DEFINITIONS

The term "footprint" is employed herein to identify that area in which a ball touching down on a tennis court or other playing surface is in contact with the playing surface. The reader will of course appreciate that the size of the footprint will increase and that its shape will change after the ball initially contacts the surface of the court.

"Automatic line calling system" is a term employed herein to identify a system invented by applicants for accurately ascertaining whether any part of a ball: (1) touched down on a boundary line of a playing surface and therefore in bounds, or (2) beyond the boundary line and therefore out of bounds. It will be appreciated that a ball may initially touch down out of bounds but that the ball may subsequently come into contact with a boundary line as the footprint of the ball changes; our automatic line calling system will accurately indicate in this circumstance that the ball landed in bounds.

"Touchdown" is used herein to indicate that an airborne ball has made contact, be it ever so brief and in bounds or out of bounds, with a playing surface.

"Unattended play" is a mode of operation of our line calling system in which all functions ancillary to actual play, including the making of rulings, are performed by the players;

"Attended Play" is a mode of operation of that line calling system in which control over the game is exercised, rulings made, and score kept by one or more officials. "Activatable" is a term employed to identify a condition of a playing surface associated electrical circuit or network incorporated in an automatic line calling system in which the circuit or circuits are open but can be closed to a produce a flow of current by a conductive game device bridging the (or two adjacent) conductors of the circuit or network when that device lands on the playing surface.

BACKGROUND OF THE INVENTION

A number of techniques for eliminating the human element in determining whether a ball or other airborne missile or projectile landed in bounds or out of bounds on a playing service have heretofore been proposed. One of these employs the mark a ball leaves upon impact with the surface of a clay court or an artificial claylike court made from a composition such as Hardtru as an indication of whether or not the ball landed out of bounds.

This technique is of course inapplicable to hard surface courts. Furthermore, if the ball contacts the surface at a small angle, the mark left in the court surface by the ball may well lie outside the boundary line, even though it brushed the boundary line in flight. Thus, the mark indicates that the ball landed out of bounds although it was officially in bounds according to the rules of tennis.

Related approaches involve coating the playing surface and/or ball with chemical compositions capable of reacting to produce a visual mark when the ball contacts the playing surface. One system of this character is disclosed in U.S. Pat. No. 4,109,911 issued Aug. 29, 1978, to John A. Van Auken for GAMING SURFACE CONTACT DETECTING SYSTEMS.

The approach just discussed has the same disadvantage as that utilizing scuff marks in the surface of a clay or artificial clay court to ascertain where a ball touched down. That is, the ball may actually contact the outer edge of the playing surface boundary in flight, and therefore be officially in, yet leave a mark which lies entirely beyond the boundary line and therefore suggests that the ball landed out of bounds.

In fact, the just-related situation is typically aggravated because the tapes employed to mark the boundaries of clay, Hardtru, and other claylike tennis courts commonly protrude slightly above the playing surface. As a consequence, a ball indicated by a visual mark to have landed as much as one-half inch out of bounds may in fact have touched the tape as it approached touchdown and therefore have officially been in bounds.

Chemically based systems also have the disadvantage that it is at best difficult to so control the chemical reactions producing the colored mark that the mark will disappear in a reasonably short length of time under the widely varying temperature and humidity conditions in which tennis is commonly played. That the mark disappears is a requisite in the operation of a satisfactory chemical system. Otherwise, the boundary line areas of a court will become so cluttered with marks that it would become, at best, difficult to determine where a newly arrived ball touched down.

Yet another solution to the problem of accurate line calling involves the use of pressure sensitive switches on tennis court boundary lines to detect the touchdown of balls on those lines. Despite the claims made by the developers of such systems, they have proved incapable of discriminating to an acceptable extent between the touchdown of a ball and the impact made if a player steps on the boundary line, even though relatively complex and costly discrimination circuits have been included in such systems. Furthermore, a player can easily trick a system of this character by striking the boundary line with his racket.

Also, there is a distinct limit on the length which a pressure switch can have and still remain accurate. The numerous spaces between the switches are dead areas. Consequently,there are many areas on a court employing a pressure sensing line calling system which can not detect a ball touching down on the playing surface. One particular and critical circumstance of this character is at the outer edges of a boundary line. A pressure sensitive switch cannot detect with any degree of accuracy whether a ball lands on or just beyond that edge.

Furthermore, a contact which is sufficient for a ball to properly be called in bounds might not generate sufficient force to trigger a pressure sensitive device. In this circumstance, also, a system employing pressure sensitive devices would make the wrong call.

Thus, systems of the foregoing character, such as those disclosed in U.S. Pat. No. 4,365,805 issued Dec. 28, 1982, to Levine for SYSTEM FOR MONITORING TENNIS COURT BOUNDARY LINES and the related, pressure sensor systems discussed in that patent, have not been accepted by the tennis world.

Yet other heretofore proposed systems, such as the infrequently used Cyclops marketed in the United States by Essential Sports, Long Island, New York, rely upon the breaking of an infrared, visible light, radio frequency, or other beam spaced above the tennis court to predict whether a ball will land on the boundary line of a tennis court or other playing surface and therefore touch down in bounds. These systems are often unable to discriminate between beams broken by: (1) an insect flying through the beam, a player's foot or other anatomical member, or a racket or other implement wielded by the player; and (2) the ball or projectile. Because it can be triggered by a player as well as a ball, the Cyclops system can be used only during service (and even then only in singles matches) to detect faults, and a separate operator must be employed to turn the system on and off just before and after a ball is served.

Line calling systems with infrared and pulse duration detectors and other exotica that are purportedly capable of discriminating between a ball and a player's foot have been proposed. However, as far as we know, none of those systems have ever been demonstrated to be practical.

Devices employing light beams and a predictive mode of operation are also difficult to maintain in alignment and notoriously inaccurate, particularly in the cases of looping serves and of balls touching down at high speed and at a low angle. A ball of the just-mentioned character landing as much as two inches behind the outer edge of a boundary line may be called "in" by a Cyclops system.

The possibilities for misalignment are equally objectionable. Play on a court must be halted to correct a misalignment.

Variations in the contour of the court surface can also adversely affect the accuracy of the Cyclops system (or any other line calling system with a detector employing a beam of energy).

In addition, only limited use can be made of such systems for a further reason. The requirement for a transmitter and a detector at opposite ends of each boundary line precludes their use on the boundary line between the add and deuce service courts and elsewhere on a tennis court, depending upon whether a doubles or singles match is in progress.

The Cyclops system has the further disadvantage that only a limited span of coverage is afforded. Thus, this system does not meet the proposed specifications of the U.S. Tennis Association. These require that a line calling system be able to call balls landing as far as two feet out of bounds without human assistance. Multiple beams systems for each boundary line that might conceivably solve this problem. However, they would be prohibitively expensive to manufacture, install, align, and operate, especially in those common circumstances where the playing surface is of the rollup type and is moved from location to location. The software for such a system would be correspondingly complex and cumbersome.

Those systems employing pressure sensing devices are also objectionable for the reasons discussed in the preceding paragraph. No one has as yet disclosed how to make a two foot wide pressure sensor which will accurately detect incoming balls, let alone discriminate between contacts by balls and contacts by a racket, player's foot, etc.

The Cyclops system is also incapable of making net calls. A light beam follows a straight line whereas the top edge of a tennis net describes a catenary curve. It is contact with the net that counts, not contact with an imaginary straight line which coincides with the top of the net only at the ends of the net. Thus, a light beam can not make let calls with any degree of accuracy.

Strain gauges and audio transceiver systems have also been employed in net calling systems. These, too, are unsatisfactory. For example, a light breeze or impact by a tennis racket can trigger any strain gauge system sensitive enough to detect ball-with-net contact. And partisan fans quickly learned that they could defeat an audio let detecting system with a loud hand clap.

Yet another touchdown sensing system heretofore proposed is that disclosed in U.S. Pat. No. 3,774,194 issued Nov. 20, 1973, to Jokay et al. for GAME COURT BOUNDARY INDICATOR SYSTEM. In the Jokay et al. system, a specially designed ball: "has an effect on a secondary antenna system" buried beneath the playing surface. This change in the antenna signal is detected and utilized to provide an indication that the ball touched down on a boundary line.

Tennis balls with the circuitry required to effect detectable changes in the signal received by a buried antenna system are impractical and would probably be prohibitively expensive to manufacture. Also, the buried antenna systems would probably be equally expensive to install. Furthermore, the use of radio frequency signals would lead to obvious problems in the areas of tuning, sensitivity, and RF noise A line calling system with similar objections uses the detection of a magnetic flux change to ascertain whether a ball lands in or out of bounds. Aside from being inaccurate, such a system would be expensive to install and maintain; and it would probably not even be capable of determining if a ball came from across a net or simply bounced back onto the playing surface from an out of bounds location closely adjacent the boundary line.

Yet other systems for eliminating fallible human determinations of whether a tennis all has touched down in or out of bounds are disclosed in above-discussed Van Auken '911 patent. Those systems include a network of parallel, spaced apart, exposed electrical leads extending along each of the tennis court boundary lines and a companion network of similarly related leads lying in the out of bounds area immediately adjacent each boundary line. Alternate leads of each network are connected to an electrical power source, and the remaining leads are grounded.

A conductive tennis ball is employed. If that ball lands on a boundary line when it touches down and contacts two adjacent leads of the boundary line network, current will flow in a circuit containing those two leads. This current is a signal indicating that the ball landed in bounds.

A ball touching down in the out of bounds area immediately adjacent a boundary line may similarly bridge two leads or conductors of the out of bounds network located in that area. This provides an indication that the ball touched down out of bounds.

While a vast improvement over those other line calling systems discussed above, the system disclosed in the Van Auken '911 patent nevertheless has its disadvantages and drawbacks.

One is that it is maybe less accurate than desirable because no effort is made to locate conductors precisely on the outer edges of the boundary lines. As a consequence, a ball touching down and having a footprint initially in an out of bounds area but then expanded to the outer edge of the boundary line may not contact a boundary line-associated conductor. As a consequence, such a ball may be determined by the patented system to be out of bounds even though it should have been called "in" in accord with the official rules of tennis.

In addition, those techniques for providing conductor networks which Van Auken '911 discloses have been found to be less than entirely satisfactory. Conductive threads as disclosed in that patent (made by twisting together silver plated Nylon fibers) were found to be less durable than is desirable, and the electrical characteristics of those threads also left something to be desired.

Extruded conductors fitted into grooves in rigid playing surface panels as described in Van Auken '911 proved even less satisfactory because of the time and expense involved in cutting the grooves and in leveling the court with the precision required for the playing surface to lie flat. In addition, the heat of the sun caused the ends of the rigid panels to curl upwardly resulting in an unacceptable, uneven playing surface.

Another significant disadvantage of the line calling systems disclosed in Van Auken '911 is that the players or official (s) can not selectively activate or deactivate the conductor networks associated with particular tennis court boundary lines. This function is a requisite in a practical system as different boundaries are employed: (a) in singles and doubles play, and (b) (i) during service, and (ii) any subsequent volleying.

Related disadvantages of the Van Auken '911 system are that no provision is made for configuring that system to: (1) provide the different outputs that are appropriate to attended and unattended play, or (2) select different combinations of visual and audio signals, or (3) make both in bounds and out of bounds calls or out of bounds calls only.

Other touchdown sensing systems employing electrical conductors and a conductive ball and having drawbacks like those discussed above in conjunction with the Van Auken '911 patent are disclosed in the following U.S. Pats. 3,883,860 issued May 13, 1975, to Von Kohorn for ELECTRICAL INDICATOR SYSTEM FOR BALL GAMES; 4,071,242 issued Jan. 31, 1978, to Supran for ELECTRICALLY CONDUCTIVE TENNIS BALL; and 4,299,384; 4,433,840; and 4,664,378, all issued to John A. Van Auken and respectively entitled ELECTRICALLY CONDUCTIVE GAME BALL, ELECTRICALLY CONDUCTIVE GAME BALL, and ELECTRICALLY CONDUCTIVE TENNIS BALL.

SUMMARY OF THE INVENTION

We have now invented, and disclosed herein, certain novel automatic line calling systems for tennis and other games which do not have the disadvantages of the previously proposed, above-discussed approaches to eliminating the human element in determining whether the balls or other projectiles employed in such games touch down in bounds or out of bounds on the playing surface.

In general, the novel automatic line calling systems we have developed are like those discussed above and disclosed in Van Auken patent No. '911 in that they include one network of parallel, spaced apart conductors extending along each playing surface boundary line and a second network of similarly disposed conductors in the out of bounds area immediately adjacent each boundary line. As in the Van Auken '911 system, the conductors are alternately energized and connected to ground so that the footprint of a touching down ball or other projectile with a conductive surface can be located by identifying the conductors that were bridged by that projectile. Also, as in the case of the patented system, the current flowing in a network with bridged conductors is utilized to provide an indication of whether the projectile touched down out of bounds or in bounds.

Nevertheless, the novel, automatic line calling systems disclosed herein differ from the line calling systems disclosed in the Van Auken '911 patent and the related patents identified above in several important respects.

One is that conductors fabricated from stainless steel or other appropriate metal wire are employed rather than the conductive threads or specially configured conductors disclosed in the Van Auken '911 patent. These conventionally configured metal conductors, which are fastened to the playing surface by a nonconductive thread, are substantially more durable than the conductive threads employed in the patented systems. Also, they have superior electrical characteristics; and they are available at only a fraction of the cost of those specially extruded conductors disclosed in the Van Auken '911 patent.

The conductors we employ are easily sewn to the flexible tapes employed to mark the boundary lines of clay courts. They are equally easily attached to flexible vinyl coverings such as those constituting the upper layers of rollup playing surfaces.

Alternatively, the electrical conductors can be incorporated in a woven grid of nylon or other nonconductive filaments. The resulting grid is attached to the playing surface, be it of the hard surface of rollup type, with an appropriate adhesive.

The novel, automatic line calling systems disclosed herein also differ from the systems disclosed in the Van Auken '911 patent and others of a comparable nature in that one conductor is located precisely at the outer edge of each playing surface boundary line. As a consequence, balls which have a footprint that initially lies entirely out of bounds but thereafter expands to this edge coincidental conductor will complete a circuit and produce a current signal that, properly processed, will result in the system making an "in bounds" call as is proper.

The novel, automatic line calling systems disclosed herein also differ significantly from those patented systems employing conductive balls and playing surface-associated conductors in that the system employed to process the signals generated when adjacent conductors are bridged are significantly different and in that networks appropriate to different modes of play can be selectively activated. For example, the novel signal processing systems disclosed herein permit an official, by simple switch manipulation, to activate the electrical networks which are appropriate for: service in each of the four service courts, subsequent volleying, and singles or doubles play. Furthermore, our novel signal processing and control system also provides for, again by simple switch manipulation, those outputs which are appropriate for attended or unattended play; such visual and/or audio signals as may be wanted in a given setting; and similar signals when a let is detected.

At the same time, durability and dependable operation is provided as is versatility. Our novel, automatic line calling systems are equally adaptable to clay (and Hardtru and other artificial claylike) courts, hard surfaces; and rollup playing surfaces. Furthermore, breaks in the conductors can be readily detected and easily repaired on the infrequent occasions when breaks occur.

OBJECTS OF THE INVENTION

From the foregoing, it will be apparent to the reader that one important and primary object of the present invention resides in the provision of novel, improved systems for accurately determining whether a ball or other missile-type device lands in or out of bounds on a tennis court or other playing surface.

Other, related and also important objects of our invention reside in the provision of systems as described in the preceding paragraph:

which are accurate;

which are dependable and easily serviced;

which are capable of providing the proper "in bounds" indication if the airborne device first touches down out of bounds and the footprint of the device is then so altered by continued ball-with-surface contact that it comes into contact with a boundary line of the playing surface;

which are eminently suitable for both attended and unattended play;

which are adaptable to a variety of playing surfaces including hard surface, clay, artificial clay, and rollup tennis courts;

which do not affect the playing surface in a manner that the players would find annoying or unsafe or detrimental to their game or otherwise unsatisfactory;

which, in tennis court applications, can readily be programmed to make calls appropriate to both singles and doubles play as well as the appropriate calls when the ball is served and when it is thereafter kept in play; and which can be easily and quickly programmed to provide a variety of outputs such as visual and audio signals, a combination of such signals, signals only if the game device touches down out of bounds, or a signal when the game device touches down in bounds and therefore remains in play as well as a signal when the device touches down out of bounds.

Still another important and primary object of the present invention resides in the provision of systems for automatically detecting contact between an airborne game device and a net or other barrier extending across a playing surface in those circumstances where the device continues across the barrier and may consequently not have been observed to touch the barrier.

A related and also important object of our invention is the provision of systems as described in the preceding paragraph which are accurate and dependable.

Another important object of the invention is the provision of automatic line calling systems as characterized in preceding objects in which provision is made for detecting lets in the manner identified in the last paragraph but one.

And yet another important and primary object of the present invention resides in the provision of playing surfaces and/or nets or other barriers with novel electrical networks which are part of and contribute to the successful operation of systems with the advantages and attributes identified in the preceding objects.

Other important objects and features and additional advantages of the invention will be apparent to the reader from the foregoing and the appended claims and as the ensuing detailed description and discussion proceeds in conjunction with the appended claims.

DETAILED DESCRIPTION OF THE INVENTION

Figure 1:
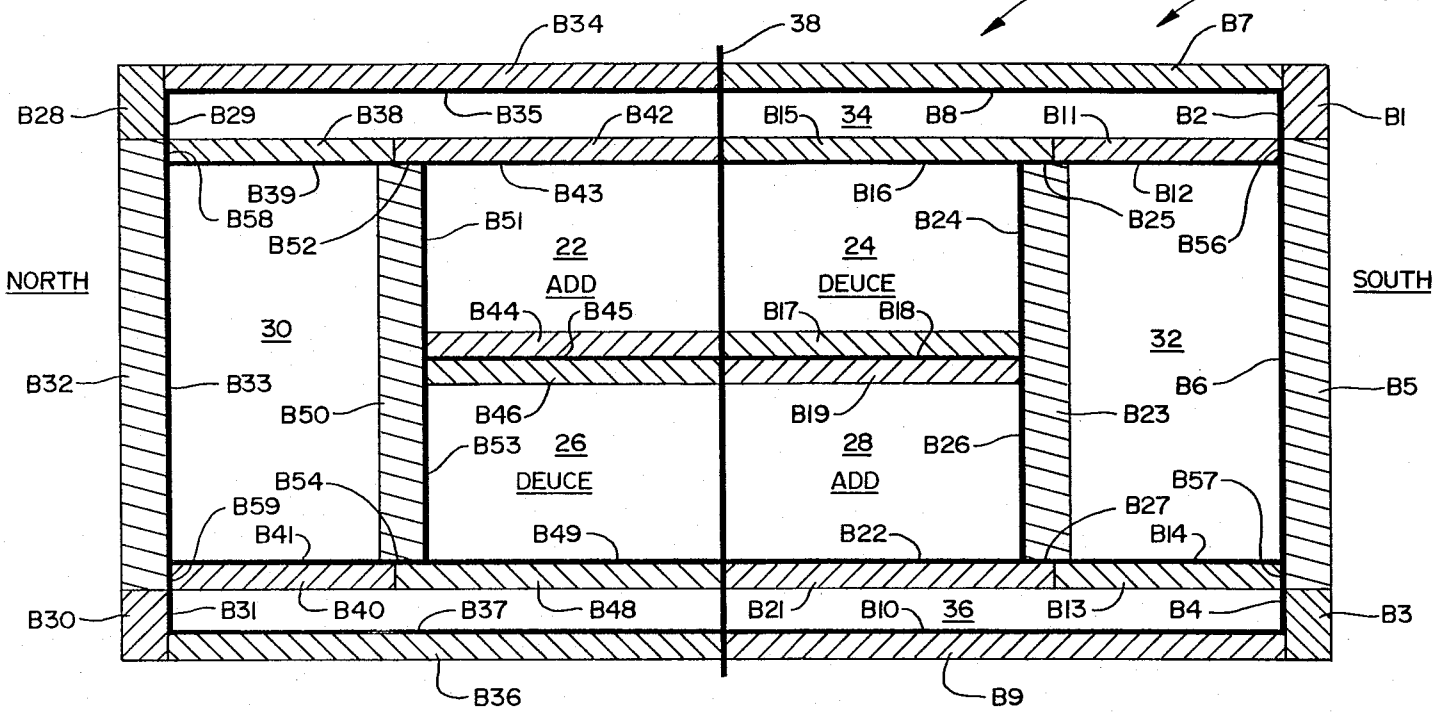
FIG. 1 is a plan view of a tennis court equipped with networks of electrically conductive elements in accord with the principles of the present invention to automate the process of determining: (1) whether balls touching down on the court surface land in or out of bounds, and (2) whether balls travelling over the net have come into contact with it.

Referring now to the drawing, FIG. 1 depicts a tennis court 20 with the usual service courts 22, 24, 26, and 28; back courts 30 and 32; and alleys 34 and 36. A net 38 extends across court 20 between the North service courts 22 and 26 and the South service courts 24 and 28.

The several playing areas of tennis court 20 identified in the preceding paragraph are delineated by boundaries which are two inches wide. In accord with the principles of the present invention, a network of parallel, equally spaced apart electrical conductors is located on each boundary. The conductors extend along and parallel to the edges of the boundaries, and one of the conductors is coincident with the outer edge of each boundary.

Different ones of the boundaries illustrated in FIG. 1 are employed: (1) during service and during any subsequent volleying, and (2) during doubles and during singles matches. So that networks appropriate to each of the foregoing can be activated at proper times, the boundaries of tennis court 20 are divided into 28 segments, 14 on each side of net 38. A separate electrical network as just described is provided for: (1) each of those segments, and (2) for an out of bounds area immediately adjacent each boundary line segment. Also, as will become apparent below, provision is made for activating different combinations of boundary line networks and out of bounds networks for singles and doubles play and during service and any subsequent volleying. Furthermore, provision is also made for activating different combinations of networks depending on whether North or South is serving and whether service is being made into an add or deuce court.

On the South side of court 20, back boundary line segments B56, B6, and B57 are activated during singles and double play; and back boundary line segments B2 and B4 are activated in addition to the foregoing segments during doubles play. Side line segments B8 and B10 are activated during doubles play, and side line segments B16, B25, and B12 on the East side line and B22, B27, and B14 on the West side line are activated during singles play. If North is serving into the South deuce court 24, the networks on boundary line segments B16, B24, and B18 are activated. Similarly, when North is serving into South's add court 28, the networks on boundary segments B19, B26, and B22 are activated. The corresponding networks on the North side of court 20 are activated during singles and doubles play and when South is serving into the North add and deuce courts 22 and 26.

Once service has been effected, the center service boundary segment B18 is deactivated as is the previously activated boundary segment B24 or B26 at the back line of the service court. Also, if a doubles match is being played, the previously activated service court side line boundary segment B16 or B22 is deactivated.

It was also pointed out above that electrical networks of the character just described are provided in the out of bounds areas immediately adjacent each of the boundary lines of tennis court 20. These out of bounds networks on the South side of court 20 are identified by networks on the South side of court 20 are identified by reference characters B7, B1, B5, B3, B9, B15, B11, B13, B21, B23, B17, and B19.

Side line networks B7, B1, B5, B3, and B9 are activated during doubles play; and side line networks B15, B11, B13, and B21 are activated during singles matches. Irrespective of whether a singles or doubles match is being played, out of bounds networks B15, B23, and B19 are activated when North is serving into the South deuce court 24; and networks B19, B23, and B21 are activated when North is serving into the South add court 28. Once service has been effected, network B23 the previously activated out of bounds network B17 or B19 will be deactivated; and the out of bounds network B15 or B21 previously activated during service will also be deactivated if a doubles match is being played.

The corresponding out of bounds networks on the North side of tennis court 20 are activated and deactivated in a similar pattern for singles and doubles matches and during service and subsequent volleying.

Optionally, other of the out of bounds networks may also be activated at different times to detect balls which touch down out of bounds. To this end, one might, for example, activate out of bounds networks B12 and B14 during service into South's deuce and add courts 24 and 28, respectively; and the out of bounds segments B1 and B3 (and/or B7 and B9) could be activated during singles matches.

We pointed out above that: (1) each of the boundary line and out of bounds electrical networks on tennis court 20 are composed of electrical conductors alternately connected to an electrical power source and to ground; (2) a tennis ball touching down on a boundary line or out of bounds network bridges conductors of that network; and (3) discrete, identifiable circuits accurately indicative of the location in which the ball touched down are therefore completed by the contact of the conductive ball with the playing surface.

The tennis balls employed to operate line calling systems in accord with the principles of the present invention may be of any desired construction. Preferred, however, are those disclosed in U.S. Pat. No. 4,664,378 issued May 12, 1987, to John A. Van Auken for ELECTRICALLY CONDUCTIVE TENNIS BALL.

Figure 2:
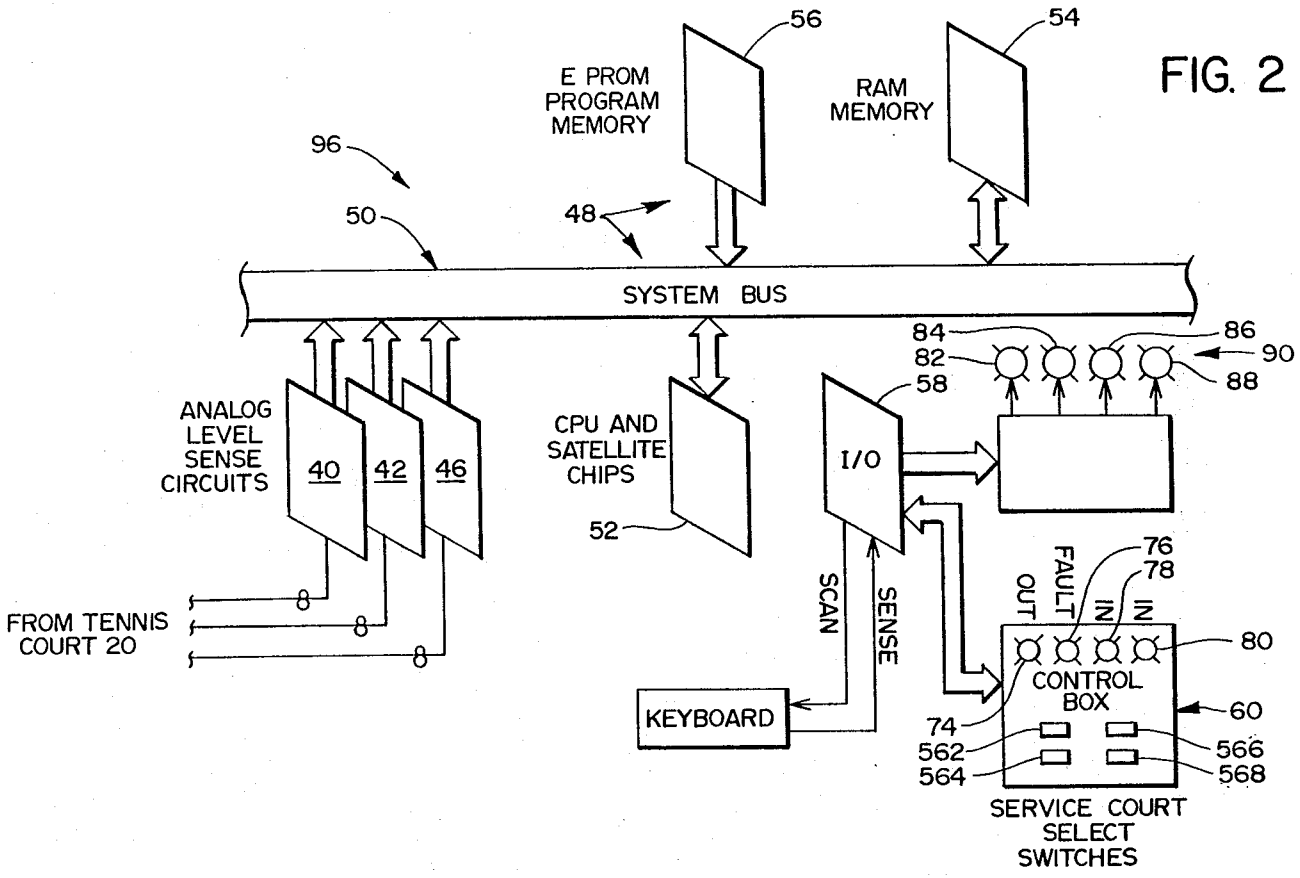
FIG. 2 is a schematic diagram of electronic and electrically operated components which cooperate with the electrical leads on the tennis court of FIG. 1 and on the net of that court to provide an automatic line calling and let detecting system embodying the principles of the present invention.

Turning now to FIG. 2, those circuits which are completed each time a ball touches down on a boundary line or out of bounds network are identified by sensor circuits contained on three cards 40, 42, and 46. Each sensor circuit receives inputs from a different one of the boundary line and out of bounds networks.

Latches triggered by the sensor circuits and also contained on cards 40, 42, and 46 are polled to determine which out of bounds and/or in bounds circuits may have been closed by the touchdown of a conductive ball on tennis court 20. This is accomplished by a microprocessor 48 which is connected to cards 40, 42, and 46 by a system bus 50.

Microprocessor 48 includes a central processing unit 52 with satellite chips; a RAM 54 for storing data acquired from cards 40, 42, and 46; and an EPROM 56 in which the operating instructions for the microprocessor are stored. The microprocessor also includes input/output ports 58 and a control box 60 with connections to the input ports.

The control box has four manual switches S62, S64, S66 and S68. These enable an official to temporarily activate, during service, those boundary line and associated out of bounds networks which are appropriate to the service court 22, 24, 26, or 28 into which service is being made. Two additional control box switches S70 and S72 (see FIG. 12b) enable the players or an official to activate those boundary line and out of bounds networks which are appropriate for singles and doubles play, respectively, and to configure the system as appropriate for attended and unattended play.

Outputs from microprocessor I/O unit 58 are used to turn on visual, control box indicators or lamps 74, 76, 78, and 80 and, at the option of the official or players, corresponding indicators or lamps 82, 84, 86, and 88. One set of lamps 82 . . . 88 is mounted on each of the wind screens or back fences of tennis court 20 (one wind screen/back fence display is shown pictorially in FIG. 12A and identified by reference character 90).

Lamps 74 and 82 (red) light up when a ball touches down out of bounds whereas lights 76 and 84 (amber) are illuminated to identify a service fault. Lamps 78 and 86 (blue) are turned on to indicate that a serve is in whereas lamps 80 and 888 (green) are illuminated when a ball touches down in bounds.

The in bounds indicators 86 and 88 in wind screen/-back fence displays 90 can be deactivated during unattended play to minimize distractions to the players. This is permissible as the out of bounds indicators 82 and 84 will continue to operate, and it can be assumed that any ball which did not cause one of those signals to turn on as it touched down in bounds.

Figure 10:
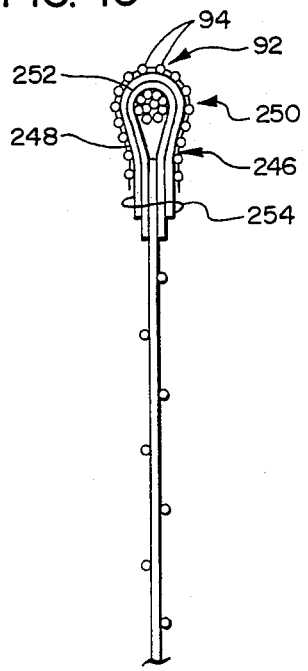
FIG. 10 is a partial vertical section through the net of the tennis court; this figure shows a network of conductors which, when bridged by contact of a conductive tennis ball, can be used to generate a signal indicating that a let has occurred.

We also pointed out above that the net 38 of tennis court 20 is preferably equipped with a network of electrical conductors similar to those installed on the playing surface. This enables the line calling system to detect lets; i.e., those instances where the ball being served contacts net 38 but continues over the net and lands in bounds in the proper service court (the detection of lets is important because let calls are the most controversial of all and because the server is entitled to an additional serve in the event of a let). This network is identified in FIG. 10 by reference character 92. It is made up of conductors 94.

Signals generated when a conductive ball hits net 38 and bridges adjacent energized and grounded conductors 94 in network 92 are also fed to microprocessor 48. After processing, these signals are employed to flash on and off the red lamp 74 is control box 60 and, optionally, the red lamps 82 in wind screen/back fence indicator arrays 90.

A final, optional component of the automatic line calling system shown in FIGS. 1 and 2 (hereinafter identified in its entirety by reference character 96) is a keyboard 98 which can be employed to program microprocessor 48 in lieu of burning in EPROM 56.

Figure 5:
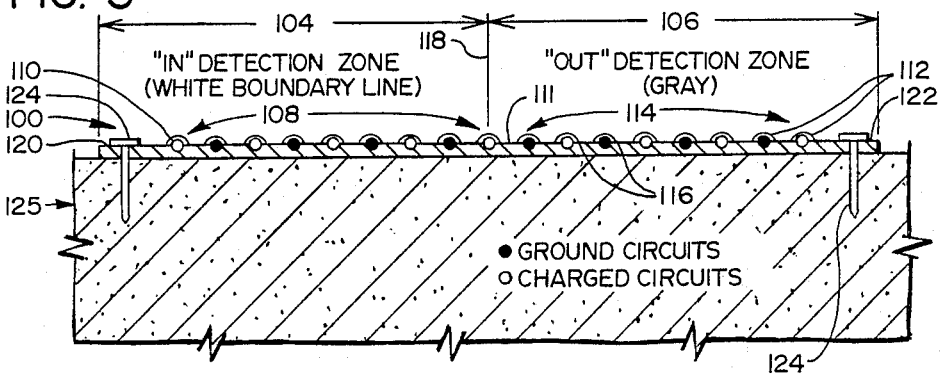
FIG. 5 is a pictorial section through a clay court in which a strip of the character shown in FIG. 3 has been installed to sense the touchdown of balls on or near a boundary line of the court.

Referring still to the drawing, FIG. 5 depicts a tennis court playing surface made of clay or an artifial clay substitute such as Hardtru or Lee Fast Dry (these compositions are typically applied over a clay base). The boundary lines of conventional courts of this character are marked by two inch wide, flexible, vinyl or other tapes. The tapes are nailed to the playing surface.

In courts equipped with an automatic line calling system 96 in accord with the principles of the present invention, these conventional tapes are replaced by four inch wide tapes 100 (see FIG. 5) except along the lines between the North service courts 22 and 26 and the South service courts 24 and 28. Here, six inch wide tapes 102 (see FIGS. 3 and 4) are employed.

Referring first to FIG. 5, those tapes everywhere on court 20 except along the lines dividing the add and deuce courts have a two inch wide, white boundary portion 104 and an out of bounds, also two inch wide portion 105. This out of bounds section of the tape is typically colored gray to match the court surface.

One network 108 of longitudinally extending electrical conductors 110, typically spaced 0.25 inch apart, is sewn to the upper surface 111 of the boundary line portion 104 of tape 100 by nonconductive threads 112. These conductors are so located that one conductor 110 of boundary line network 108 will lie precisely on the outer edge 118 of the tape's boundary line portion 104. A second, similarly related set or network 114 of electrical conductors 16 is sewn to that portion 106 of each tape 100 which lies out of bounds when the tape is installed on the playing surface.

The inner and outer margins 120 and 122 of tape 100, typically 0.5 inch wide, are free of electrical conductors. Nails 124 are driven through these marginal portions of the tapes 120 to secure them to the clay, Hardtru, or other playing surface 125.

Conductors 110 and 116 can be fabricated from an 8–10 mil, flexible and relatively soft, type 302 stainless steel wire. This material combines acceptable conductivity with durability, corrosion resistance, and other desirable physical characteristics. Also, the relative softness allows the electrical conductors to adopt a configuration which matches that of the playing surface.

A tough, durable thread (available from Universal Thread or Coates) is employed as is tight, lock-type stitching. Eight stitches per inch is satisfactory.

Figure 3:
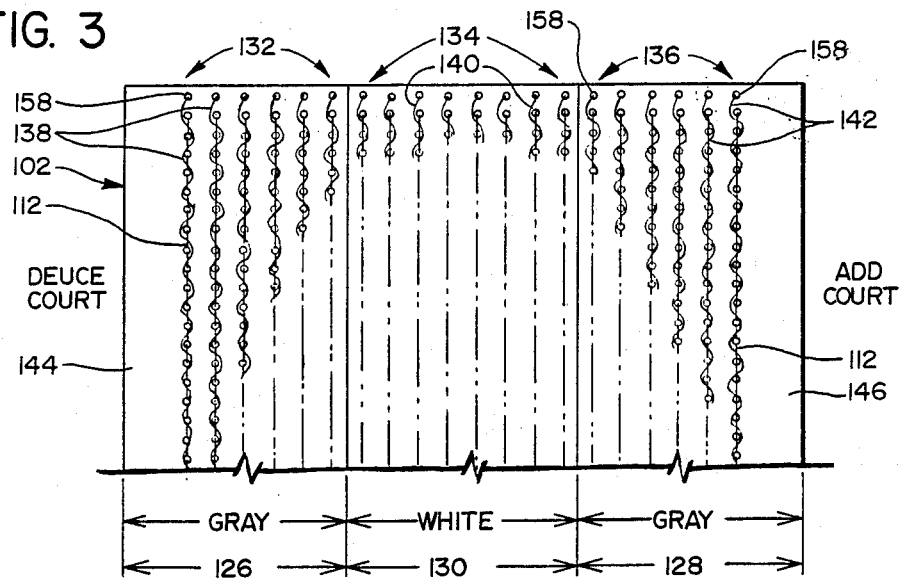
FIG. 3 depicts a strip of a material employed to denote the boundary lines on clay and comparable courts; this strip bears exposed electrical circuit leads for sensing the touchdown of tennis balls on or near a boundary line of a court.

To maximize that proportion of each conductor 110 which is exposed and thereby guarantee that the conductor can be contacted by an impacting ball, the stitches are laid down in a straight line (as far as the needle holes through the tapes are concerned); and the conductor is displaced first to one side of this row of holes and then to the other, generating the zigzag conductor pattern shown in FIG. 3. Also, this keeps the wire out of the way of the sewing machine needles as it is sewn down. This prevents the conductors and/or needles from being broken.

The tapes 102 employed between the two North service courts 22 and 26 and the two South service courts 24 and 28 are duplicates of tapes 100 except that each of the tapes 102 has a gray or other colored out of bounds section on each side of a white boundary section. The two gray out of bounds sections of tape 102 are identified by reference characters 126 and 128 in FIG. 3. The white central section constituting the boundary line is identified by reference character 130.

Sewn to each tape 102, again by nonconductive threads, are three networks 132, 134, and 136 of longitudinally extending, parallel, spaced apart conductors 138, 140 and 142. As in the case of tapes 100, 0.5 inch wide margins 144 and 146 are left on each side of a tape 102 so that the tape can be nailed to a playing surface.

It will be appreciated by the reader that tapes 102 are provided with two out of bounds sections 126 and 128 because one side of white boundary line section 130 will be out of bounds when service is made into the deuce service court bounded by it whereas the other side of that section will be out of bounds when service is being made into the neighboring add court. As a corollary, the out of bounds conductor network 132 will be activated when service is being made into the add court shown in FIG. 3 whereas that network will be deactivated and the second out of bounds network 136 activated when service is being made into the deuce court.

Alternate conductors 110 and 116 of the boundary line and out of bounds networks 108 and 114 on each tape 100 are collected, and these leads of the two networks are separately connected to an electrical power source. The remaining conductors 110 and 116 are connected to a common ground.

A similar scheme is employed to connect up the conductors 138, 140, and 142 of the two out of bounds networks 132 and 136 and the boundary line network 134 of each tape 102. Every other lead (including those in all three networks 132, and 136) is connected to a bus 148 which is, in turn, connected to ground. The remaining ("hot") leads 138 . . . 142 in out of bounds network 132, in boundary line network 134, and in out of bounds network 136 are collected and respectively connected to buses 150, 152, and 154.

With the hot lead uses 150 . . . 154 of the three networks 132, 134, and 136 connected to separate sensor circuits on cards 40 . . . 46, microprocessor 48 can ascertain by polling those circuits whether a ball touching down on a tape 102 landed in bounds (in which case at least one conductor 140 of network 134 is bridged to an adjacent lead). A different sensor circuit indicates that the ball touched down out of bounds adjacent a boundary line when that sensor circuit is triggered (in this case, no conductor 140 of boundary line network 134 is connected by the tennis ball to an adjacent conductor, either in the boundary line network or the activated out of bounds network 132 or 136).

Figure 4:
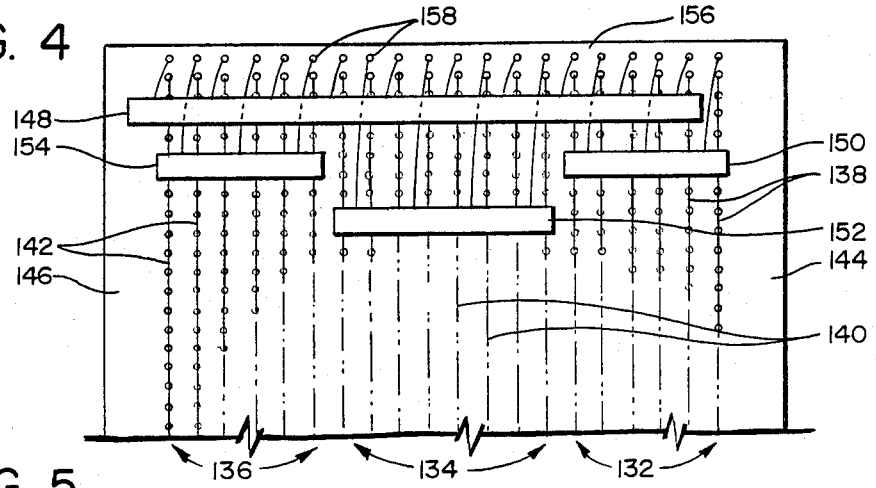
FIG. 4 is a bottom view of the strip shown in FIG. 3 and is included to show the buses used to connect up different ones of the leads.

The system used for connecting up the conductors 110 and 116 in the boundary line and out of bounds networks 108 and 114 of a tape 100 employs buses like those shown in FIG. 4. However, in the case of a tape 100, only two buses for connecting the alternate, energizeable conductors to the power source are required — one for the hot conductors 110 of boundary line network 108 and the second for the hot conductors 116 of the out of bounds network 114.

As mentioned above and is shown in FIG. 5, it is preferred that one boundary line network conductor of each tape 100 or 102 lie precisely on one (or each edge) of that tape section beyond which a ball touching down is out of bounds. This provides great accuracy in determining whether a ball landing on court 20 is in bounds or out of bounds. Even is a ball first touches down out of bounds, the call will properly be made that the ball landed in bounds provided that, after touchdown, the footprint of the ball expands to and touches the edge-located conductor. That completes a current path between the edge-located conductor and the first adjacent conductor of the out of bounds network, thereby producing a flow of current which can be utilized to generate an in bounds signal.

Nevertheless, if it is for some reason deemed desirable to locate the outermost conductor of the boundary line network to one side of the boundary identifying edge, this can readily be accomplished as is apparent from FIG. 3. For example, it might be considered desirable to have the tapes 100 and 102 be no wider than those providing the present two inch boundary lines. This could be done. However, accuracy would be lost.

It will be noted, in conjunction with the foregoing, that the out of bounds networks on tapes intended for clay and Hardtru and similar playing surfaces span only a relatively narrow two inches. This is all that is required because balls landing on those surfaces leave scuff marks. Such scuff marks can be employed to identify balls which touch down more than two inches out of bounds.

Figure 7:
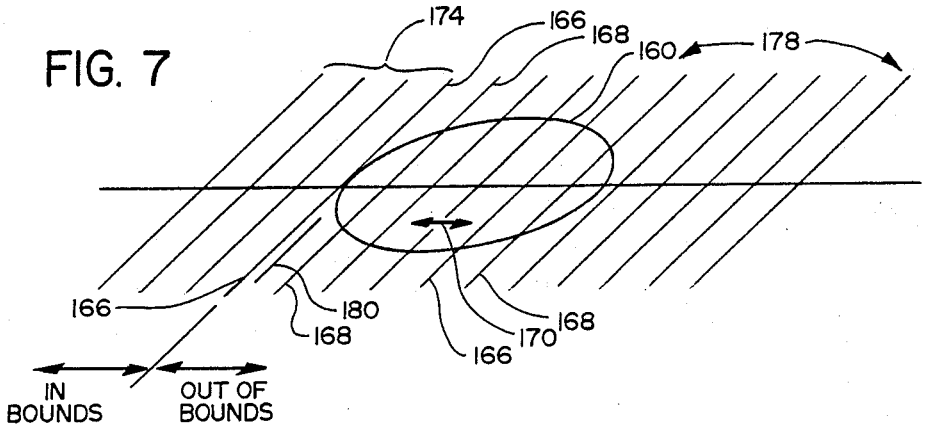
FIG. 7 shows the footprint of the tennis ball on the surface of the court and the electrical leads which are contacted and bridged by the ball after it has been in contact with the playing surface long enough to leave the illustrated footprint.

Referring again to the drawing, FIG. 7 shows a representative footprint 160 for a conductive tennis ball 162 which has touched down on a playing surface 164. Parallel, spaced apart, alternately charged and grounded conductors 166 and 168 are located on this surface in accord with the principles of the present invention. These conductors provide circuits which can be completed by the conductive tennis ball to generate electrical signals. This makes it possible to accurately and automatically locate where the tennis ball touched down.

Figure 6:
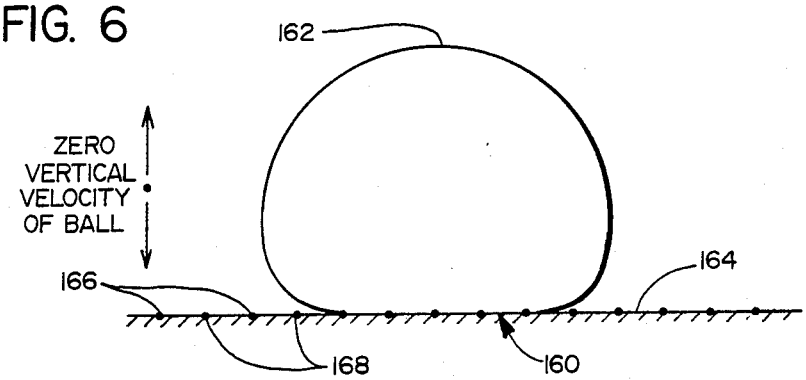
FIG. 6 is a side view of a tennis ball showing the flattened configuration which a tennis ball assumes after it touches down on the surface of a tennis court.

In the representative circumstance depicted in FIG. 6, ball 162 has zero velocity and is therefore about to rebound. As a consequence, its footprint 160 is of maximum size. Thus, the footprint has expanded as shown by the double-headed arrow 170 in FIG. 7 until this footprint (which was initially out of bounds and would have resulted in ball 162 being called out by typically, heretofore proposed, line calling systems) has touched the outermost, hot conductor 166 in boundary line conductor network 174. Consequently, tennis ball 162 has completed a circuit between that conductor and the adjacent, grounded conductor 168 of out of bounds conductor network 178. Current flowing through this circuit is utilized by microprocessor 48 to generate a signal correctly indicating that ball 162 touched down (or landed) in bounds.

On the other hand, had the footprint 160 fallen just short of the outermost boundary line conductor 166 as indicated by line 180 in FIG. 7, the circuit between that conductor and the adjacent grounded conductor in network 174 would not have been completed, but circuits between adjacent conductors in out of bounds network 178 would have been. In that case, the currents flowing in the completed circuits would have been utilized by microprocessor 48 to generate an output indicating that ball 162 touched down out of bounds.

Turning again to the drawing, we pointed out above that the principles of the present invention are readily adaptable to rollup tennis courts such as those manufactured by Supreme Courts of Cartersville, Georgia.

Figure 8:
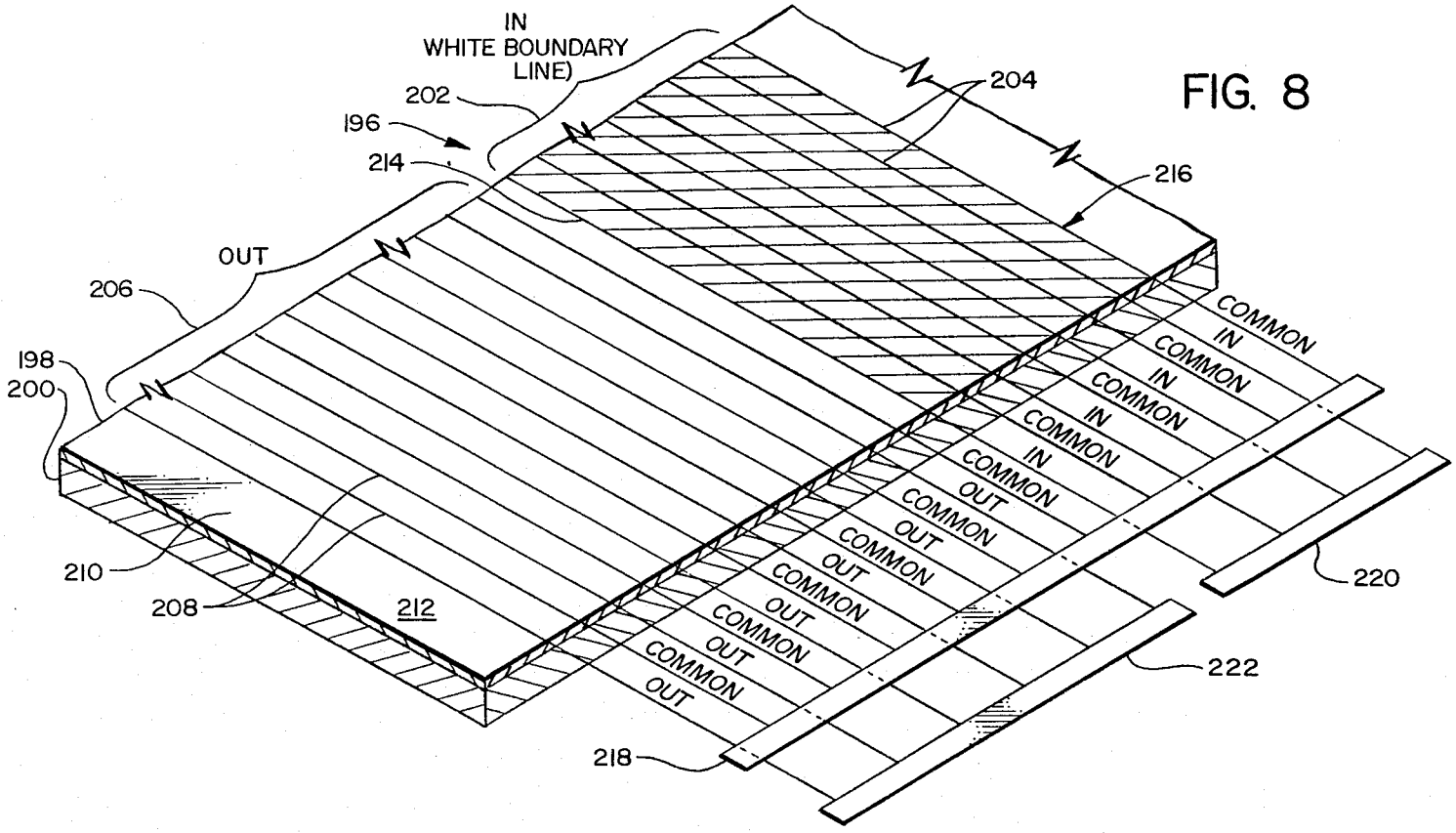
FIG. 8 is a pictorial view of one fragment of a rollup tennis court which includes a boundary line; this figure depicts a series of exposed electrical circuits which, when appropriately bridged by a conductive tennis ball, generate one or more signals identifying with precision that area of the court contacted by the tennis ball as it touches down.

As shown in FIG. 8, rollup or removable playing surfaces like that identified by reference character 196 typically have a flexible, wear resistant, vinyl or other polymeric surface layer 198 coated onto a fiberglass scrim and backed by a layer 200 of foam rubber or other shock absorbing material. The principles of the present invention are adapted to a rollup playing surface such as 196 by sewing or otherwise attaching a network 202 of parallel, spaced apart, longitudinally extending, boundary line conductors 204 and a cooperating network 206 of similarly related out of bounds conductors 208 to the upper surface 210 of a strip of material 212. The outermost conductor 204 of boundary line network 202 is preferably superimposed on the outer edge 214 of boundary line 216. Strip 212 is of the same character and thickness as the top layer 198 of playing surface 196. Appropriate sections of the latter are cut away and detached. The strips 212 with the attached boundary line and out of bounds networks 202 and 206 are installed in the slots or recesses left by the removal of the cut away sections of the playing surface upper layer.

As in the case of the boundary line delineating tape 100 illustrated in FIG. 5, alternate conductors 204 and 208 of the two networks 202 and 206 are connected to a common, grounded bus 218. The remaining hot or charged leads of boundary line network 202 are connected to a second bus 220, and the hot leads 208 of out of bounds electrical network 206 are connected to a third bus 222.

Thus, a ball touching down out of bounds but bridging at least two conductors 208 of out of bounds network 206 will cause a signal to appear on bus 222. This signal, processed by microprocessor 48, is used to turn on a visual or other signal indicating that the tennis ball touched down out of bounds. Conversely, if a circuit including at least the outermost conductor 204 of boundary line network 202 is completed by the ball touching down, a signal will instead (or also) appear on bus 220. In this case, the microprocessor 48 will generate an output which energizes an "in bounds" indicator, irrespective of whether or not an out of bounds input was generated.

Figure 12:
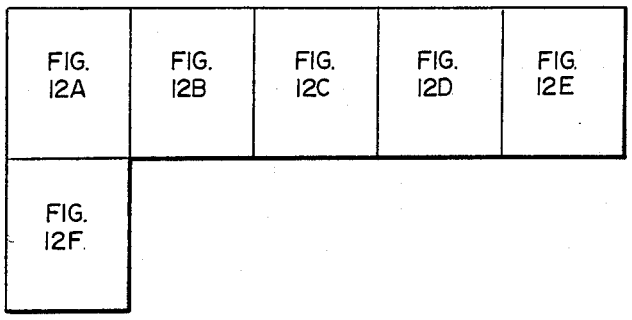
FIG. 12 shows the relationship among FIGS. 12A–12F which, taken together, constitute a schematic diagram of a system for: (a) processing signals generated by completion of boundary line and out of bounds circuits as shown in FIGS. 3 or 8 or 9 and the net-associated circuits shown in FIGS. 10; (b) indicating visually and/or audibly whether or not a ball landed in or out of bounds and providing similar indications of lets, and (c) controlling and programming the operation of the line calling and let detecting system.
Figure 12A:
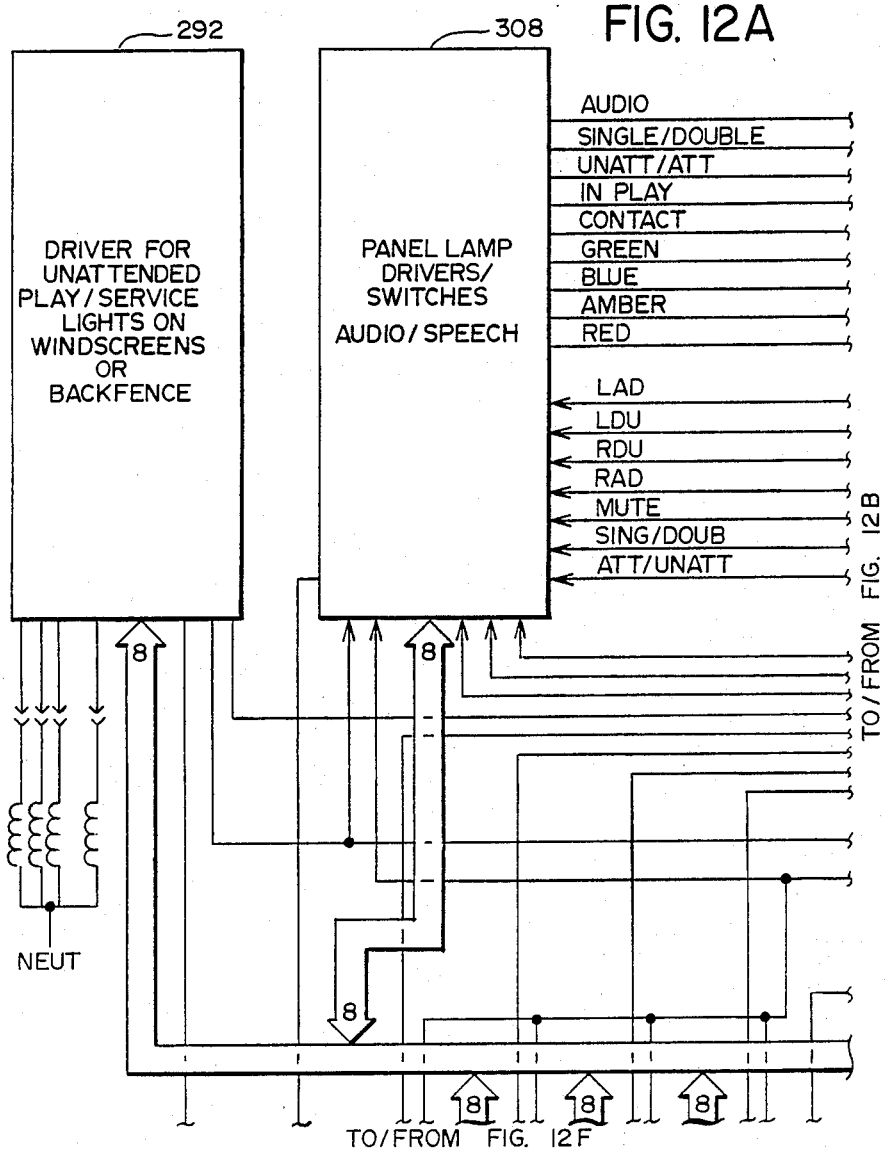

Connections must be made between the boundary line and out of bounds networks illustrated in FIG. 1 and between the networks and the cables (not shown) connecting the networks to the signal processing circuitry of line calling system 96 (FIGS. 2 and 12). Other connections must be made between the net associated conductor network 92 and microprocessor 48. These connections are preferably made by male and female plugs sealed in a watertight canister or casing (likewise not shown). These canisters are typically buried so that they will not be tripped over by, or otherwise be in the way of, the players, spectators, or officials. The particular connect-up scheme is not critical; and the details will accordingly not be covered herein for the sake of brevity.

Scuff marks cannot be relied upon to determine where a ball lands on a court 196 of the type illustrated in FIG. 8. Therefore, to ensure that "out" calls which might not be obvious to a player or official are made by the automatic line calling system, out of bounds networks 206 15 inches wide are employed at the side lines of court 20. Twenty-four inch wide out of bounds networks 206 are employed at the back lines. That is, the side line and service court dividing networks B7, B11, B15, B17, B19, B21, and B13 on the South side of court 20 and the corresponding networks on the North side of the court are 15 inches wide. The back line associated out of bounds networks B1, B5, B3, and B23 and the corresponding network segments on the North side of the court are 24 inches wide.

As mentioned above, hard surface courts are made of asphalt and concrete and materials of that character surfaced with a vinyl coating such as Deco Turf, Plexipave, or Flexicushion. Hard surface courts can also be readily equipped with automatic line calling systems employing the principles of the present invention.

Figure 9:
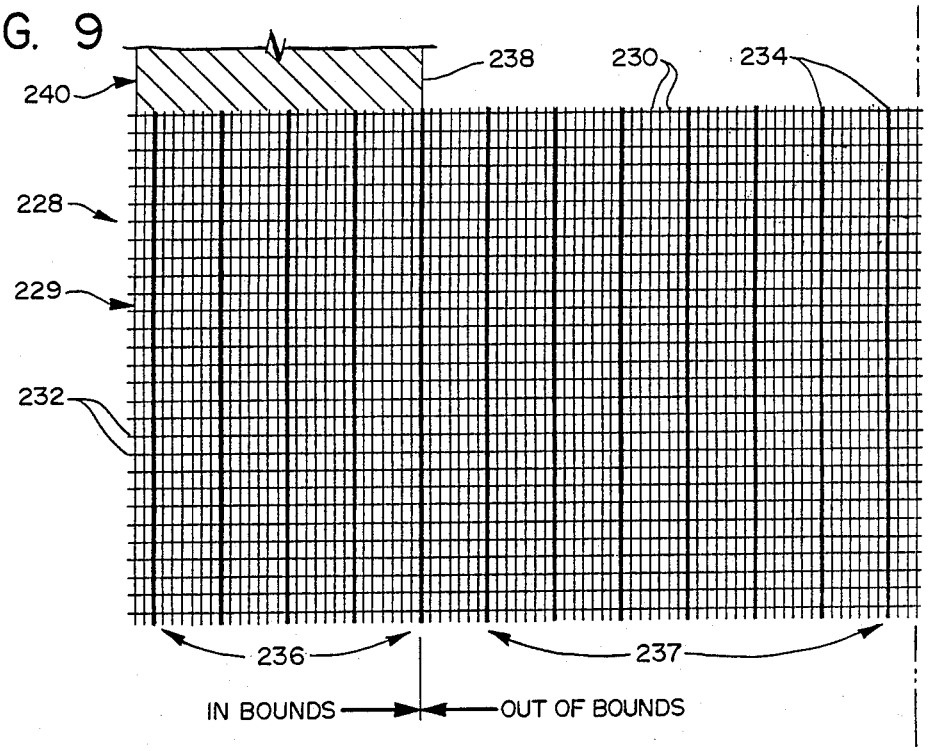
FIG. 9 is a plan view of a grid which may be adhesively affixed to the surface of a tennis court to provide thereon a network of exposed electrical leads of the character shown in FIGS. 3 and 8.

Electrical conductor networks required to automate the line calling functions may be provided by grooving the court surface and installing tapes as shown in FIG. 8 or, preferably, by applying to the upper surface of the court appropriately dimensioned grids of the character illustrated in FIG. 9 and identified by reference character 228. Grids of this type are available from Bay Mills, Ontario, Canada.

Grid 228 includes a conductor retaining mesh 229 woven from warp and woof filaments 230 and 232 of a nonconductive polymer, typically a Nylon. At equidistantly spaced, again typically 0.25 inch intervals, the warp filaments 230 are replaced by flexible electrical conductors 234. These will typically be fabricated of a soft 302 stainless steel as in the previously discussed embodiments of our invention.

As is apparent from FIG. 9, conductors 234 are securely held in place at the prescribed intervals by the woof elements 232 of mesh 229. Alternate woof filaments 232 respectively pass over and under each of the electrical conductors 234.

Again, as discussed in conjunction with other embodiments of our invention, the conductors 234 are grouped into a boundary line network 236 and an out of bounds network 237. The outermost conductor 234 of boundary line network 236 lies precisely on the outer edge 238 of the boundary line 240 (identified by hatching in FIG. 9).

This grid or screen approach has several advantages. One is that installation and the replacement of defective boundary line and out of bounds networks is simplified. For example, a defective or worn out grid does not even have to be removed as a replacement can simply be laid on top of the defective one, bonded in place, and connected up electrically.

Also, electrical network bearing grids as just described can be installed without cutting away the surface layer of a rollup court or grooving a hard surface court as is required to install a tape as shown in FIGS. 3—5 or in FIG. 8. This is important because the initial high cost of a rollup court may make the owner reluctant to let it be cut into as is required for the installation of the FIG. 8 type of networks.

Further, the conductive grids are not thick enough to adversely affect play when laid on the surface of a tennis court. This eliminates the costly and time consuming groove cutting process required to flush install electrical network assemblies as shown in FIG. 8 in a hard surface court.

Another advantage of the grid-type electrical network system is its relatively low cost.

Once installed, the grid material can be appropriately painted to provide a white boundary line and one (or two) out of bounds areas which match the color of the playing surface on which the grid is installed.

Figure 11:
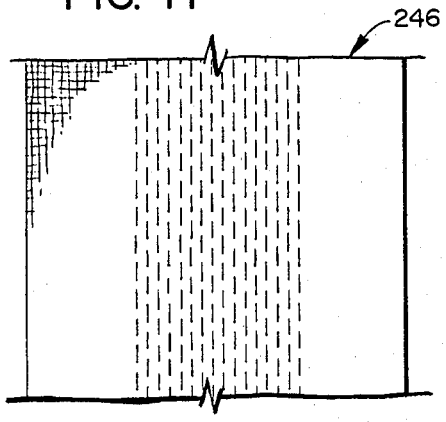
FIG. 11 is a fragmentary plan view of a fabric incorporating the exposed conductors and attached to the head tape of the net to provide the let detection network.

We pointed out above that the net 38 of tennis court 20 is preferably equipped with a parallel conductor network to detect lets which might otherwise be miscalled by the players or an official. The network was above-identified by reference character 92 and the individual conductors by reference character 94. These conductors, in a manner akin to that discussed above in conjunction with grid 228, are woven into a nonconductive fabric identified in FIGS. 10 and 11 by reference character 246. This securely retains the conductors in a parallel, spaced apart relationship. The fabric is bonded to a tape 248, and the resulting assembly 250 is trained around and secured to the upper head tape 252 of net 38 by lacing 254.

In the case of network 92, conductors 94 are fabricated from a rigid, yet springy, conductive metal, again typically a stainless steel. A conductor of this character is preferred so that impacting tennis balls, blows by a tennis racket, etc. will not bend the conductor. That would be undesirable because bent conductors might touch and cause a short, thus providing a signal indicating that a ball had touched net 38 even though it had not.

Appropriate fabrics as discussed above and illustrated in FIG. 11 are available from the Schlage Corporation of Rochester, New York.

Referring now to FIGS. 12A–12F, we pointed out above that: (1) latches are triggered to identify the network or networks with circuits completed by the touch down of a conductive tennis ball on court 20; (2) these latches are located on cards 40, 42, and 46; and (3) the latches are polled by microprocessor 48 to ascertain which boundary line and/or out of bounds networks contained circuits that were completed by the touchdown of the ball.

Figure 12B:
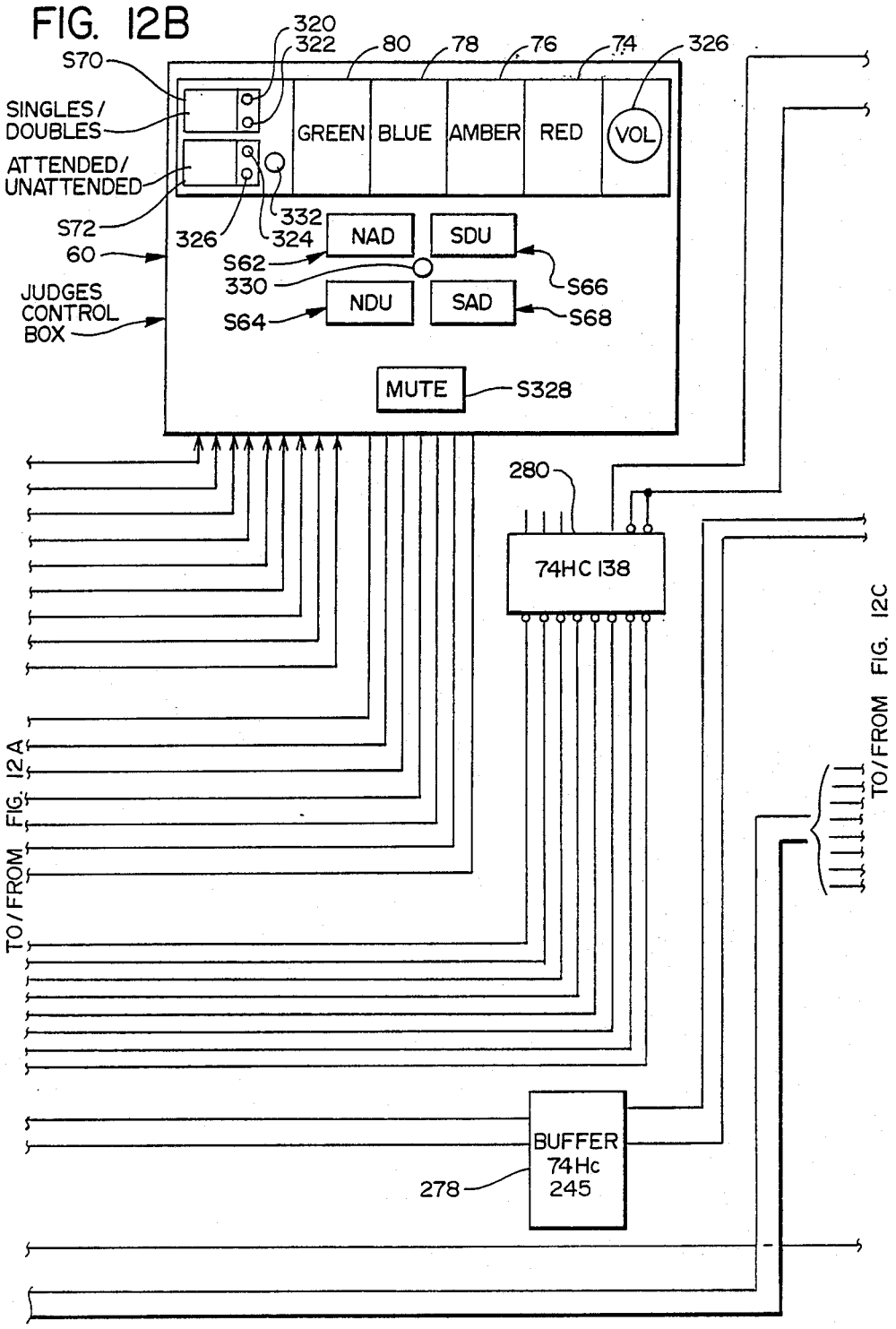
Figure 12C:
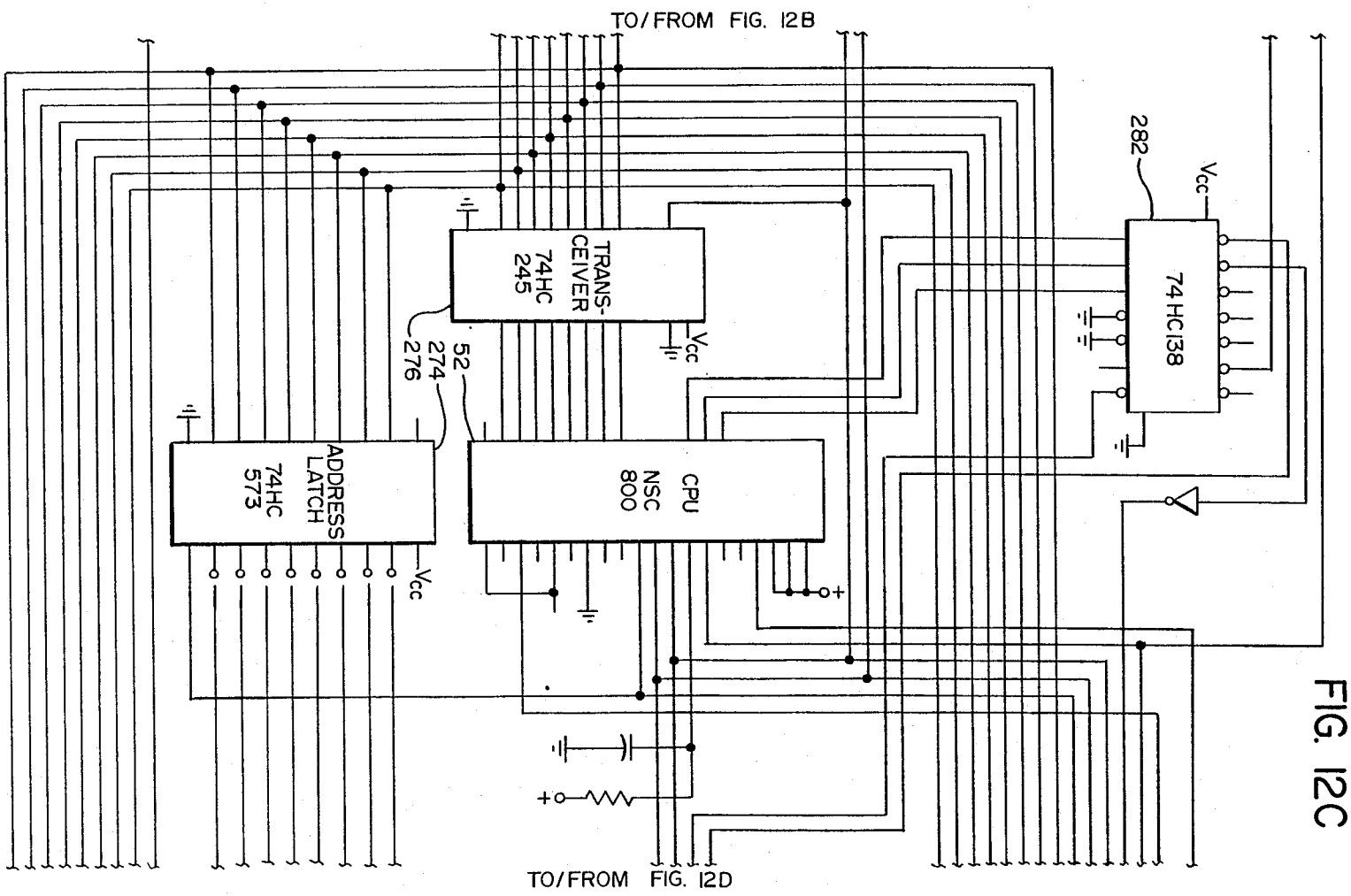
Figure 12D:
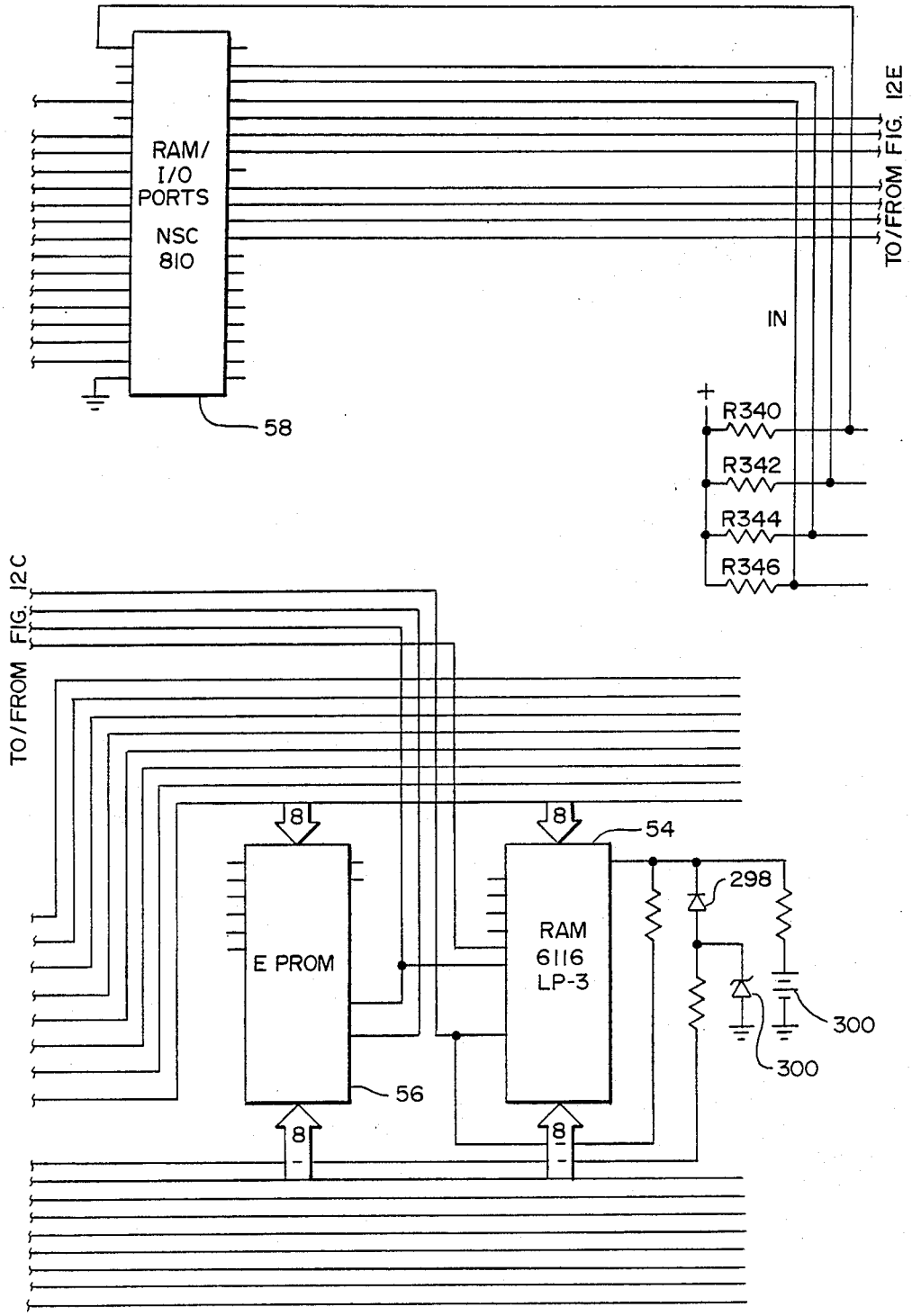
Figure 12E:
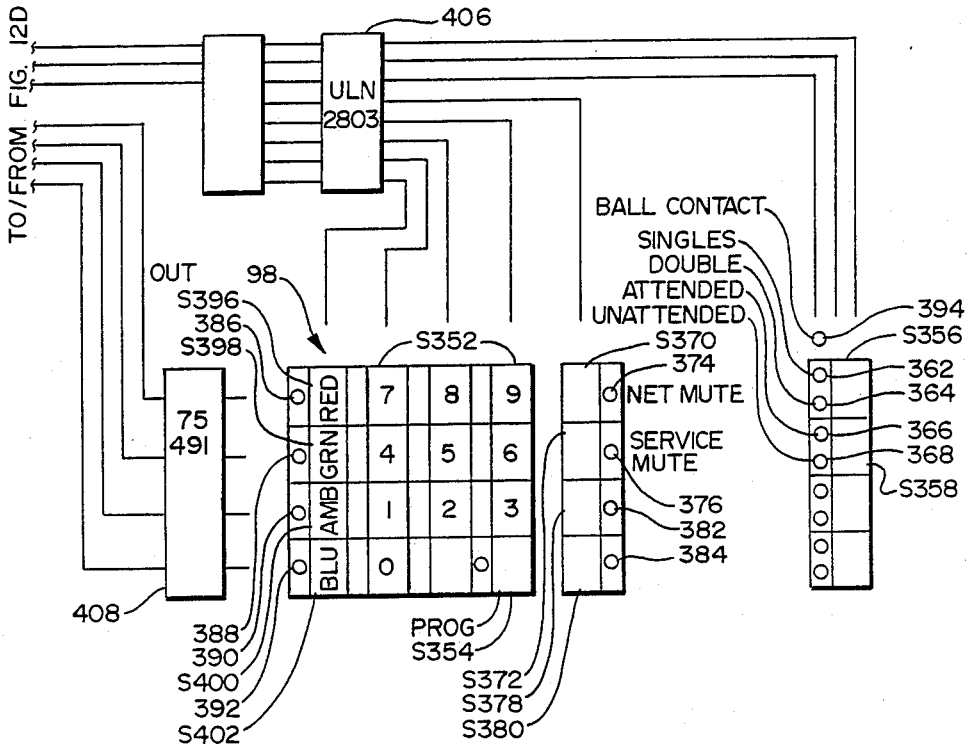
Figure 12F:
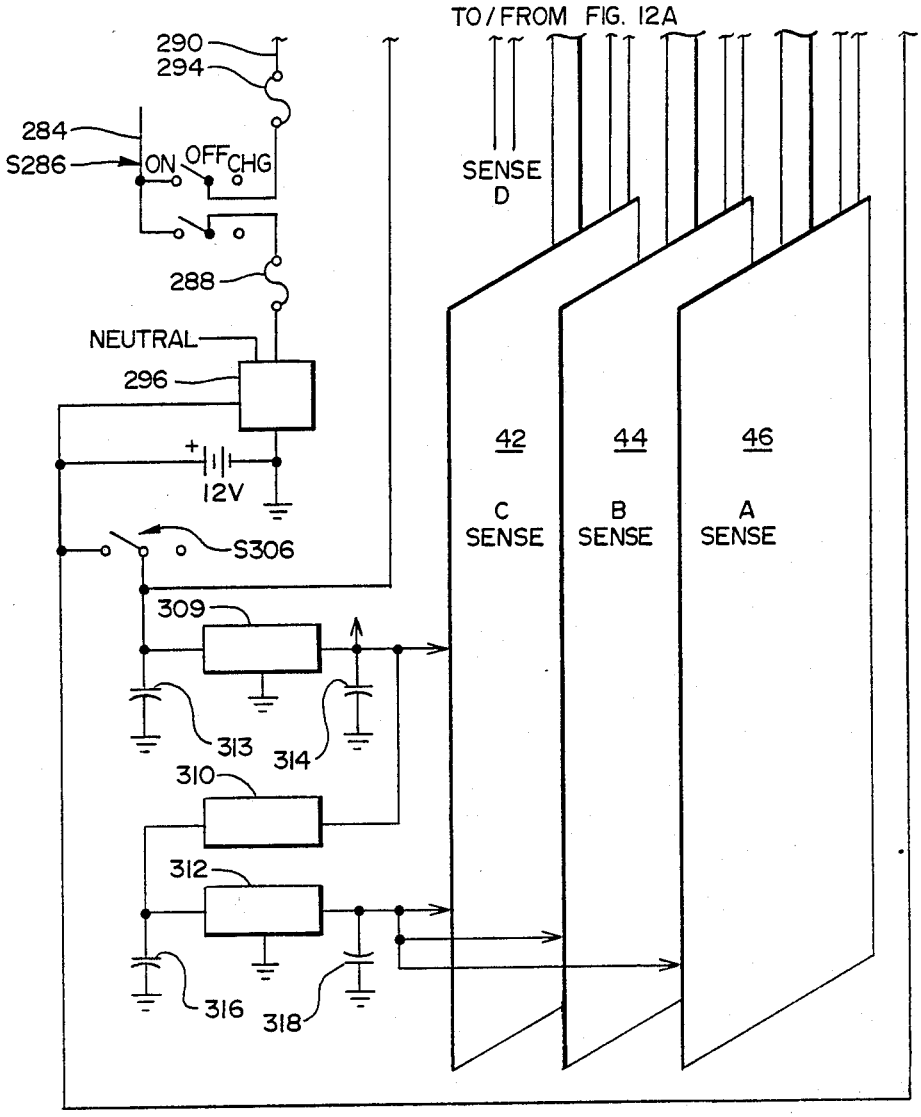
Figure 13:
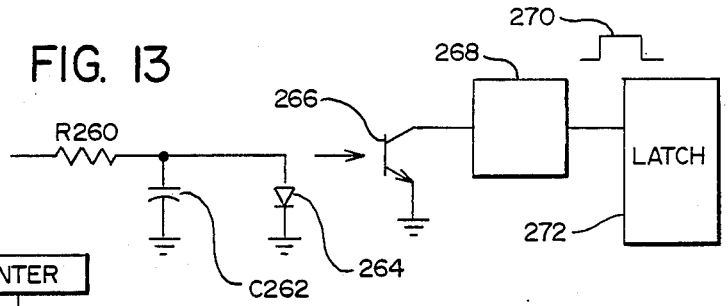
FIG. 13 is a wiring diagram for a sensing circuit and latch employed in the system of FIG. 13.

More specifically, and with reference to FIG. 13, each boundary line and out of bounds circuit from tennis court 20 is connected through a filter consisting of a resistor R260 and a bypass capacitor C262 and through an optical coupler consisting of a light emitting diode 264 and a transistor-type detector 266 to a monostable vibrator 268. The resistor R260 and capacitor C262 filter out low energy, high frequency impulses from the incoming signal; and the optical coupler isolates the signal processing circuitry shown in FIGS. 12A–12F from the tennis court associated circuitry. The optical coupler also distinquishes incoming signals of a high enough magnitude to indicate that a court associated circuit has been completed. The RC filter and the optical coupler further distinquish legitimate incoming signals indicative of a ball having touched down on court 20 and completed a boundary line or out of bounds circuit from spurious signals such as one from a circuit momentarily completed as by a foil chewing gum wrapper blowing across the court, for example.

When a signal appears and energizes LED 264, making transistor detector 266 conductive, multivibrator 268 is triggered and produces a pulse 270 of specified duration. The associated latch 272 is triggered by a pulse of the specified duration but not by a spurious signal of shorter duration. It is these latches 272 which are subsequently polled by microprocessor 48 to determine which, if any, of the court associated, boundary line and out of bounds circuits were completed by the touch down of a tennis ball on court 20.

Data acquired by the polling of latches 272 is stored in RAM 54 of microprocessor 48. In addition to the central processing unit 52, that RAM, EPROM 56, and the I/O ports 58 discussed above, the microprocessor includes an address latch 274, which is required because of the operating characteristics of the NSC 800 chip that is employed in the particular microprocessor 48 shown in the drawing. Also included in the microprocessor is a transceiver 276 which acts as a buffer and keeps the microprocessor system bus 50 from being loaded down. Additional buffering is provided by a second chip 278.

Other major components of microprocessor 48 are decoders 280 and 282. These are employed in conventional fashion to reduce the number of input and output ports that are required..

The microprocessor 48 described in the preceding paragraphs and elsewhere herein has a generally conventional architecture and operates in much the same fashion as any microprocessor of comparable character. Consequently, it is not considered necessary to describe the microprocessor in more detail herein; and that will accordingly not be done.

Microprocessor 48 and those other electrically powered components of automatic line calling system 96 which appear in FIGS. 12A–12F are connected to a 110 volt A.C. power source through an electrical lead 284 and a double pole, double throw switch S286 which has "on", "off", and "charge" positions. In the first of these positions, the power source is connected through a fuse 288 and a lead 290 to the driver 292 for the wind screen or back fence mounted visual indicators 82 . . . 88 illustrated in FIG. 2 and discussed above. With switch S286 in this "on" position, the A.C. power supply is also connected through a fuse 294; a battery charger 296; and a circuit including a diode 298, a Zener diode 300, and a 3 volt D.C. power supply 302 to microprocessor 48.

In its "charge position", switch S286 connects the A.C. power supply to battery charger 296 to charge a 12 volt D.C. power supply 304. This enables automatic line calling system 96 to remain in operation if the primary power source fails.

Downstream from switch S286 is a second, also manually operable switch S306. When closed, this switch connects the A.C. power source to the driver 308 for the visual (and hereinafter described audio) indicators on the above-described control box 60. It will be remembered that this control box is operated by an official when the automatic line calling system is configured for attended play.

The closing of switch S306 also connects the external power supply to voltage regulator 309. This voltage regulator supplies a filtered +5 volt signal compatible with the operation of the circuitry on cards 40, 42, and 46 and elsewhere in the FIG. 12 system.

A filtered −5 volt signal also required for the operation of that circuitry is obtained by connecting the output from voltage regulator 309 through a +5 to −10 volt converter 310 to a second voltage regulator 312 which steps the incoming signal to −5 volts.

The various capacitors which filter unwanted components from the +5 and −5 volt signals are identified by reference characters 313–318 in FIG. 12F. The filtering afforded by these capacitors eliminates spurious components in the signals $V_{CC}$ and −5V supplied to the circuits on cards 40, 42, and 46 and elsewhere in the electronic part of automatic line calling system 96. That prevents spurious triggering of latches 272 and other components of the system electronics.

Referring still to FIGS. 12A–12F, and most particularly to FIG. 12B, it was pointed out above that control box 60 includes a manual switch S70. That switch is used to activate boundary line and out of bounds circuits which are respectively appropriate for singles and doubles play.

We also pointed out that the second, manual control box switch S72 also shown in FIG. 12 is used to activate those circuits which are respectively appropriate for attended play and unattended play. With switch S72 in the attended position, the official manning control box 60 can activate those service court associated boundary line and out of bounds circuits which are appropriate for the court into which the ball is being served. This is accomplished by depressing the appropriate one of four control box mounted switches S62 . . . S68. With a court oriented as shown in FIG. 1, depression of the foregoing switches will respectively activate the boundary line and out of bounds circuits appropriate for service into: North add court 22, North deuce court 26, South deuce court 24, and South add court 28.

Once service has been made and the previously depressed switch S62 . . . S68 released, control over those circuits which can be completed by the touch down of a conductive tennis on the playing surface will revert to singles/doubles switch S70.

LEDs 320 . . . 325 indicate whether singles or doubles and attended or unattended play have been selected.

In unattended play, switches S62 . . . S68 are not used; and all of the service court boundary line and out of bounds associated electrical networks are activated, irrespective of the court into which the ball is being served. This mode of operation is provided as it would be impractical for a player to operate the control box switches as he is preparing to serve or to return a serve. Nevertheless, in, out, and fault calls are still automatically made in the manner discussed above; and the players are made aware of whether a ball touches down in bounds or out of bounds during service or thereafter because the appropriate wind screen or back fence mounted indicator 82 . . . 88 will be lit.

In unattended play the amber fault light will be lit when a serve lands in bounds on a deuce court but close enough to complete a circuit in the B17 network employed to detect an out of bounds touchdown for a ball served into the add court on the same side of net 38 or vice versa. Such balls are, however, readily identifiable by the players; and the indication of a fault in this case is simply disregarded.

We also pointed out above that audio signals can be employed in lieu of or in combination with visual signals. This is easily accomplished by connecting the drivers identified collectively by reference character 308 in FIG. 12*a* to an appropriate loudspeaker or other tone generator. Control box 60 is equipped with a conventional control 326 for regulating the volume of audio signals. And a mute switch S328 is also provided so that the official judging an attended match can eliminate audible signals at his discretion or at the request of the players. A headphone jack (not shown) incorporated in control box 60 enables the official judging a match to receive audio signals even after mute switch S328 is operated to eliminate audio signals which would be detectable by others.

Other components of control box 60, also shown in FIG. 12B, include visual indicators 330 and 332. After service court selection switch S62, S64, S66, or S68 is released, indicator 330 will be illuminated to indicate to the judge that only the electrical networks appropriate to the subsequent play of the ball are activated. LED 332 is illuminated to indicate that the ball has made a legitimate, circuit completing contact with a boundary line or out of bounds network.

For maximum accuracy, the signal indicating that a ball has touched down, be it in bounds or out of bounds, is not made until the ball bounces away from the playing surface, thereby breaking or interrupting the previously completed in bounds and/or out of bounds indicative circuits. This ensures, as one example, that a ball is properly called in bounds rather than out of bounds if the footprint 160 of the ball touching down is first entirely out of bounds but then reaches a lead of a boundary line network as shown in FIG. 7 and discussed above.

Referring now in particular to FIGS. 12D and 12E, pull-up resistors R340 . . . R346 are connected across the inputs of I/O ports 58. These pull-up resistors increase to approximately 0.5 millisecond the time required for an input to come up to a level at which microprocessor 48 can acquire a signal indicating that a ball has touched down and completed a boundary line or out of bounds circuit. Again, this is significant in eliminating indications of contacts caused by spurious of transient signals rather than a ball touching down.

Finally, we pointed out above that the central processing unit 52 of microprocessor 48 can be programmed by burning in EPROM 56 or by employing an optional keyboard 98. The latter, optional component of automatic line calling system 96 is illustrated in FIGS. 2 and 12B.

Keyboard 98 includes ten switches S352 labeled 0 through 9 in FIG. 12E. Particular combinations of these switches can be manipulated to program various parameters such as the audio signals that are to be generated for a particular call, the length of time for which audio and/or visual signals remain on, etc. These instructions are written into the EPROM 56 of microprocessor 48 when the keyboard switch S354 marked PROG is depressed.

In addition, keyboard 98 is equipped with a switch S356 for activating the boundary line and out of bounds networks appropriate to singles or doubles play and a switch S358 for selecting attended or unattended operation of automatic line calling system 96. LEDs 362 . . . 366 indicate whether singles or doubles and attended or unattended modes of operation have been selected.

In addition to the components just discussed, keyboard 98 includes two switches S370 and S372 for muting audio signals and LEDs 374 and 376 for indicating that those switches have been activated. The keyboard also has two blank switches S378 and S380 with accompanying LEDs 382 and 384. These switches accommodate extra functions that may be wanted by the purchaser or user of a particular automatic line calling system embodying the principles of our invention.

Also, keyboard 98 includes visual, red, green, amber, and blue indicators 386, 388, 390, and 392. These indicators duplicate those on control box 60 and on the wind screens or back fences of tennis court 20.

The last of the illustrated signalling components of keyboard 98 is an LED 394. This duplicates the LED 332 of control box 60 and is lit when a legitimate signal is generated by a touching down tennis ball.

Finally, keyboard 98 includes selection switches S396 . . . S402. Depressing one of these switches makes it possible to program the associated red, amber, blue, or green display with keyboard switches S352.

Referring still to FIG. 12E, the electronic system of automatic line calling system 96 also includes drivers 406 and a decoder 404 and 408 for the LEDs of keyboard 98. These components are again conventional and do not require comment as their details are not significant as far the present invention is concerned.

The programs run by microprocessor 48 is performing the functions discussed above are straightforward and uncomplicated, and it is accordingly not deemed necessary to discuss or depict those programs in detail herein. Nevertheless, for the sake of completeness, one representative program has been depicted in FIG. 14.

Turning now to that figure, the initial step after the program has been entered is to initialize I/O ports 58 and a stack pointer area provided for temporary data. Next, all outputs are cleared to insure that the visual (and/or audio) indicators of automatic line calling system 96 are turned off; and the registers of the microprocessor central processing unit 53 are cleared.

After these initialization steps are completed, the mode switches employed to select singles or doubles play, attended or unattended play, and the appropriate service court (if the attended mode of play has been selected) are polled; data thereby acquired by the microprocessor central processing unit 52 is stored; and outputs to the mode switch associated indicators are made to activate the appropriate one of those indicators.

At this juncture, microprocessor 48 is enabled to poll the several court circuit-associated latches grouped on cards 40, 42, and 46. It thereby acquires and stores data indicating which of those latches have been closed by a conductive tennis ball touching down on court 20 and completing the circuit which resulted in the latch being triggered.

Figure 14:
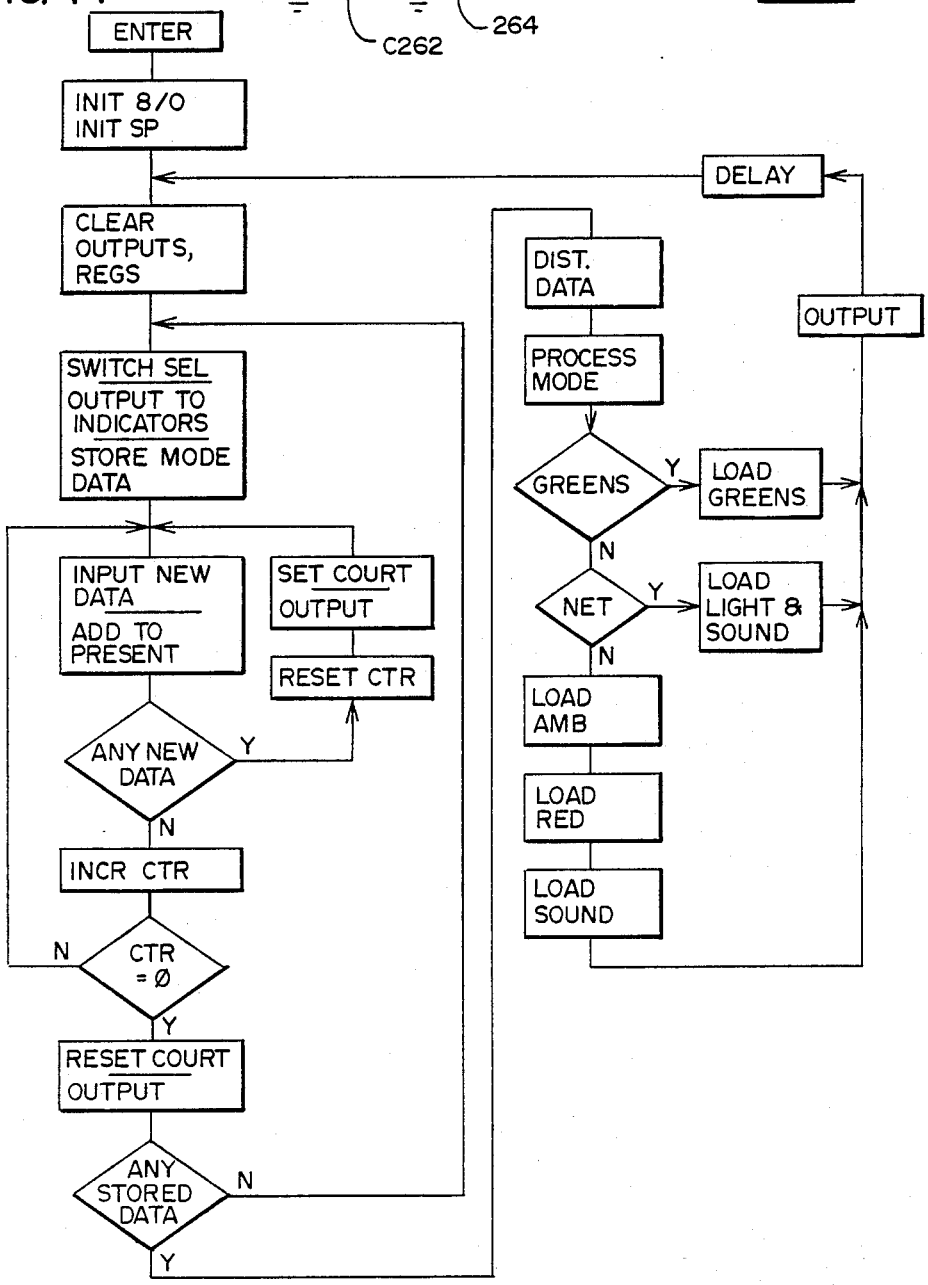
FIG. 14 is a representative flow diagram for a microprocessor incorporated in the system of FIG. 12.

The polling operation is repeated until no new data has been found for 256 consecutive cycles. Until this occurs, the central processing unit counter is reset to zero after each polling cycle is completed as shown in FIG. 14. If no new data is detected in the course of a particular polling cycle, the counter is increased as is again shown in FIG. 14.

Once 256 or some other designated number of polling cycles have been completed without any additional data having been acquired, the court outputs are reset; and microprocessor central processing unit 52 determines whether or not any data has been acquired and stored in the course of the polling process. If not, the process beginning with the storing of "mode of operation data" and the completing of outputs dictated by the mode selection switches is repeated.

If the polling process, in contrast, has resulted in data being stored by central processing unit 52, the next step in the operating sequence is to so distribute that data so that microprocessor 48 can make an expeditious determination as to whether a ball landed in bounds or out of bounds. As indicated above, this requires that determinations be made of such factors as whether those boundary line and out of bounds circuits appropriate for singles or doubles play are activated and whether the ball touching down may have first landed entirely out of bounds but ultimately have been in bounds because of an expanding footprint. As suggested as by the block labeled "process mode", it is simple and straightforward "and" and "or" comparisons of the bits of stored data after they have been appropriately distributed that is employed to make these determinations and generate an in bounds or an out of bounds output. The algorithms that are employed for this purpose are uncomplicated and straightforward.

If the processed data is compatible with an in bounds call, that data is loaded into a selected location in RAM 54 as shown in FIG. 14; and an output for turning on the green, in bounds light 80 in control box 60 and/or the corresponding lamp 88 of each wind screen/back fence display 90 is generated.

Referring still to FIG. 14, a determination is also made as to whether the ball being played struck the top of net 38. If it did, that information is also stored in RAM 54 and employed to generate an output capable of activating the visible and/or audio indicators of automatic line calling system 96. These are provided to indicate that ball-to-net contact has been made.

In unattended play, there are circumstances in which the FIG. 12 part of automatic line calling system 96 may have to turn on more than one indicator for each ball-to-court surface contact so that the appropriate indicator will be lit. Consequently, as shown in FIG. 14, data acquired from a single touchdown of a conductive tennis ball on court 20 may be loaded into more than one location in RAM 54 and subsequently employed to generate outputs that can be used to turn on a combination of appropriate indicators.

We pointed out above that tennis is by no means the only sport in which advantage can be taken of the automatic line calling systems disclosed herein. Such systems may, for example, also be used to advantage in making line calls in baseball and football and in games which do not use a ball at all, such as badminton.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalency of those claims are therefore intended to be embraced therein.

What is claimed as our invention is:

1. An automatic line calling system for a playing surface which has a boundary line, said system comprising: a first electrical network providing at least one activatable circuit on said boundary line and a second electrical network providing at least one activatable circuit lying outside of and adjacent said boundary line, each of said circuits being of a character such that it can be completed by the contact of a conductive, volant game device therewith when activated and said system further comprising sensing means operable coincidental with the touchdown of said game device on or adjacent the boundary line for identifying the network or networks with circuits which were activated by the touching down game device, signal means, control means operable in response to inputs from said sensing means for causing said signal means to generated a signal indicative of whether, upon touchdown, said game device: (a) completed only a circuit or circuits of a network lying outside of said boundary and therefore landed out of bounds, or (b) completed at least one circuit in a network lying on said boundary line and therefore landed within bounds, whether or not said game device also completed a circuit in a network lying outside of said boundary line, and means incorporated in said control means and operable if first a circuit in a network lying outside of said boundary line and then a circuit in a network lying on said boundary line is completed to cause the input from the boundary line circuit to override any inputs indicative of a circuit in a network lying outside of said boundary line having been completed.

2. An automatic line calling system as defined in claim 1 wherein the playing surface is a tennis court having a net extending thereacross and wherein the line calling system also includes: means affixed to net and including at least one electrical circuit which can be completed by the contact of a conductive tennis ball with the top of said net and means operable in response to the completion of the circuit for providing an indication that said ball contacted said net.

3. An automatic line calling system as defined in claim 1 which includes a means for storing inputs generated by the completion of circuits in the first and second network and means for polling said storage means and reporting: (a) whether an input indicative of a game device having touched down is stored, and (b) if an input as aforesaid is stored, whether any such input was generated by the completion of a circuit lying on said boundary line or the completion of a circuit lying outside of said boundary line.

4. An automatic line calling system as defined in claim 3 wherein the means for identifying those networks having circuits that are completed by the touchdown of a conductive game device as aforesaid comprises a latch associated with each of said networks, means for triggering the latch if a circuit in the associated network is completed by the touchdown of a conductive game device as aforesaid, and means for polling said latches and identifying any latches that have been triggered.

5. An automatic line calling system as defined in claim 4 with means for so controlling the operation of said polling means that a signal indicative of a ball having touched down in bounds or out of bounds will be generated only after the polling means has detected at least one triggered latch and has subsequently completed a specified number of polls of said latches without detecting any additional triggered latches.

6. An automatic line calling system as defined in claim 1 wherein the signal means provides both audio and visual signals.

7. An automatic line calling system as defined in claim 6 which comprises means for muting the audio signals.

8. An automatic line calling system as defined in claim 1 which wherein the control means includes a microprocessor for controlling the activation of said electrical networks and/or the generation of said signals and a keyboard means for programming said microprocessor.

9. An automatic line calling system as defined in claim 1 which is adapted to be operated from an A.C. power supply, said system further comprising a battery type power supply for powering said system if said A.C. power supply fails.

10. An automatic line calling system as defined in claim 1 wherein said playing surface is a tennis court and wherein the system includes means for activating during service only those networks on and adjacent lines which bound a particular service court.

11. An automatic line calling system as defined in claim 1 wherein the playing surface is a tennis court and wherein the system includes means for activating either those boundary line networks which are appropriate to singles play, or those boundary line networks which are appropriate to doubles play, and the adjacent out of bounds networks.

12. An automatic line calling system as defined in claim 1 wherein the control means comprises means for delaying the turning on of said signal means until the game device has rebounded from the playing surface and all circuits completed by the touchdown of the game device have thereby been broken.

13. A component which can be applied to a playing surface to provide an electrical network on said playing surface, said component including a removable substrate fabricated of this, flexible, nonconductive material; a plurality of elongated, flexible electrical conductors disposed in parallel, spaced relationship on the upper surface of said substrate; and, on the opposite, bottom side of the substrate: a first bus means connecting alternate conductors on a first, boundary line segment of said substrate into a first circuit; a second bus means connecting alternate conductors on a second, adjoining, out-of-bounds segment of said strip into a second, parallel circuit; and a third bus means connecting the remainder of the conductors on said substrate into a third circuit which can be connected in series with both said first circuit means and said second circuit means, whereby the conductors on the substrate provide a least one in bounds electrical circuit which can be completed by the game device touching down on a playing surface boundary line and at least one out-of-bounds circuit which can be completed if said game device touches down in an out-of-bounds area immediately adjacent said boundary line.

14. A component as defined in claim 13 which has a network of boundary lines thereon and conductors and buses as aforesaid which provide circuits as aforesaid for distinguishing between balls touching down on said boundary lines and in areas adjacent those boundary lines.

15. A component as defined in claim 14 in which said substrate has a wear resistant upper layer on which the conductors are supported and at least one, lower, shock absorbing layer.

16. A component as defined in claim 13 which has a fourth bus means connecting those alternate conductors as aforesaid on a second out-of-bounds segment of said substrate adjoining the boundary line segment but on the side thereof opposite the first out-of-bounds segment into a fourth circuit in series with said third circuit to thereby provide circuits capable of distinguishing between balls touching down on said boundary line segment and balls touching down out-of-bounds on either side of the boundary line segment.

17. A component as defined in claim 13 wherein the substrate has marginal portions which are free of conductors as aforesaid and through which fasteners may accordingly be advanced to secure said component to a playing surface.

18. A component as defined in claim 13 wherein the thread by which each of said conductor is attached to said substrate follows a straight line of holes through the substrate and wherein the conductor is alternately displaced first to one side and then to the other side of said line of holes.

19. A component which can be applied to a playing surface to provide a network of parallel, spaced apart conductors on said surface, said component comprising an open mesh substrate having electrically nonconductive warp and woof filaments bonded together at the intersections of the filaments and conductors lying parallel to said warp filaments, each of said conductors being trained over and under successive woof filaments to thereby secure the conductor to the mesh and said conductors being wires fabricated from an electrically conductive metal.

20. A system for automatically detecting contacts of a conductive, volant game device with the top of a net or other barrier in those circumstances in which the device continues across the net after the contact and such contact may therefore not have been detected, said system comprising means providing at least one electrical circuit which extends along the top of the barrier and can be completed by the contact of the game device therewith and means with an input from said circuit for providing an indication of a contact as aforesaid coincidentally with the completion of the circuit, the means providing said electrical circuit including: an elongated fabric strip folded over the top of said barrier; elongated electrical conductors extending in parallel, spaced relationship through the fabric and secured in said relationship by threads of the fabric; and means for securing said fabric to said barrier with said conductors extending in the same direction as the barrier.

* * * * *